US010344364B2

(12) United States Patent
Bassi et al.

(10) Patent No.: US 10,344,364 B2
(45) Date of Patent: Jul. 9, 2019

(54) PROCESS FOR WARM FORMING A HARDENED ALUMINUM ALLOY

(71) Applicant: Novelis Inc., Atlanta, GA (US)

(72) Inventors: Corrado Bassi, Valais (CH); Etienne Combaz, Bramois (CH); Aude Despois, Valais (CH); Pasquier Romain, Valaisa (CH); Maude Fumeaux, Valais (CH); Julie Richard, Valais (CH)

(73) Assignee: Novelis Inc., Atlanta, GA (US)

( * ) Notice: Subject to any disclaimer, the term of this patent is extended or adjusted under 35 U.S.C. 154(b) by 294 days.

(21) Appl. No.: 15/285,513

(22) Filed: Oct. 5, 2016

(65) Prior Publication Data

US 2017/0101704 A1 Apr. 13, 2017

Related U.S. Application Data

(60) Provisional application No. 62/239,008, filed on Oct. 8, 2015.

(51) Int. Cl.
*C22F 1/00* (2006.01)
*C22F 1/043* (2006.01)
(Continued)

(52) U.S. Cl.
CPC ..... *C22F 1/043* (2013.01); *B21D 22/022* (2013.01); *C21D 1/42* (2013.01); *C22C 21/00* (2013.01);
(Continued)

(58) Field of Classification Search
CPC ..... B21D 22/022; C21D 1/42; C22C 21/00; C22C 21/04; C22C 21/06; C22C 21/08;
(Continued)

(56) References Cited

U.S. PATENT DOCUMENTS 8,496,764 B2 7/2013 Luckey et al.
9,249,487 B2 * 2/2016 Yan ..... C22F 1/053
(Continued)

FOREIGN PATENT DOCUMENTS

EP 2581218 A1 4/2013
JP 2002544392 12/2002
(Continued)

OTHER PUBLICATIONS

"ASTM E1004—09: Standard Test Method for Determining Electrical Conductivity Using the Electromagnetic (Eddy-Current) Method," Jun. 2009, ASTM International, 5 pages.
(Continued)

*Primary Examiner* — Veronica F Faison
(74) *Attorney, Agent, or Firm* — Kilpatrick Townsend & Stockton LLP

(57) ABSTRACT

Described are processes for shaping a hardened heat treatable, age-hardenable aluminum alloys, such as hardened 2XXX, 6XXX and 7XXX aluminum alloys, or articles made from such alloys, including aluminum alloy sheets. The processes involve heating the article, which may be in a form of a sheet or a blank, before and/or concurrently with a forming step. In some examples, the alloy is heated to a specified temperature in the range of 125-425° C. at a specified heating rate within the range of about 3-200° C./s, for example, 3-90° C./s or 90-150° C./s. Such a combination of the temperature and the heating rate can result in an advantageous combination of article properties.

19 Claims, 14 Drawing Sheets

(51) Int. Cl.

| | |
|---|---|
| ***C22C 21/00*** | (2006.01) |
| ***C22C 21/06*** | (2006.01) |
| ***C22C 21/08*** | (2006.01) |
| ***C22C 21/10*** | (2006.01) |
| ***C22F 1/05*** | (2006.01) |
| ***C22F 1/053*** | (2006.01) |
| ***C22F 1/057*** | (2006.01) |
| ***B21D 22/02*** | (2006.01) |
| ***C21D 1/42*** | (2006.01) |
| ***C22C 21/04*** | (2006.01) |

(52) U.S. Cl.
CPC ..... *C22C 21/04* (2013.01); *C22C 21/06* (2013.01); *C22C 21/08* (2013.01); *C22C 21/10* (2013.01); *C22F 1/05* (2013.01); *C22F 1/053* (2013.01); *C22F 1/057* (2013.01)

(58) Field of Classification Search
CPC .. C22C 21/10; C22F 1/043; C22F 1/05; C22F 1/053; C22F 1/057
See application file for complete search history.

(56) References Cited

U.S. PATENT DOCUMENTS

| | | | | |
|---|---|---|---|---|
| 2006/0130941 | A1* | 6/2006 | Litalien | B21D 22/201 148/550 |
| 2012/0152416 | A1 | 6/2012 | Foster et al. | |
| 2012/0273098 | A1 | 11/2012 | Bohner et al. | |
| 2016/0326619 | A1* | 11/2016 | Bassi | C22F 1/05 |
| 2017/0101706 | A1* | 4/2017 | Bassi | C22C 21/00 |

FOREIGN PATENT DOCUMENTS

| | | | |
|---|---|---|---|
| JP | 2009242855 | | 10/2009 |
| JP | 2010196112 | | 9/2010 |
| JP | 2015039719 | | 3/2015 |
| WO | 0070115 | | 11/2000 |
| WO | 2014135367 | A1 | 9/2014 |
| WO | 2017062398 | A1 | 4/2017 |

OTHER PUBLICATIONS

"ASTM E797/E797M—15: Standard Practice for Measuring Thickness by Manual Ultrasonic Pulse-Echo Contact Method," Dec. 2015, ASTM International, 7 pages.
"ASTM E8/EM8—16a: Standard Test Methods for Tension Testing of Metallic Materials," Sep. 2016, ASTM International, 30 pages.
"International Alloy Designations and Chemical Composition Limits for Wrought Aluminum and Wrought Aluminum Alloys," Registration Record Series: Teal Sheets, Feb. 1, 2009, The Aluminum Association, Inc., 35 pages.
International Patent Application No. PCT/US2016/055415, International Search Report and Written Opinion dated Jan. 20, 2017, 10 pages.
International Application No. PCT/US2016/055415 , "International Preliminary Report on Patentability", dated Apr. 19, 2018, 9 pages.
Japanese Application No. 2018-516726 , "Office Action", dated Jan. 8, 2019, 10 pages.
Australian Application No. 2016333860 , "First Examination Report", dated Jan. 25, 2019, 3 pages.

* cited by examiner

PROCESS FOR WARM FORMING A HARDENED ALUMINUM ALLOY

CROSS REFERENCE TO RELATED APPLICATION

The present application claims priority to and filing benefit of U.S. provisional patent application Ser. No. 62/239,008 filed on Oct. 8, 2015, which is incorporated herein by reference in its entirety.

FIELD OF THE INVENTION

The present invention relates to the field of aluminum alloys and related fields.

BACKGROUND

Aluminum alloys combine low density with structural strength and crash resistance, which makes them attractive for production of structural and body parts in the motor vehicle industry. However, aluminum alloys have lower formability compared to draw-quality steel. In some cases, relatively low formability of the aluminum alloys can lead to difficulties in obtaining good part designs and create problems with failure due to fracture or wrinkling. Warm forming of aluminum alloy sheets is used in the motor vehicle industry to overcome these challenges since the aluminum alloys exhibit increased formability at elevated temperatures. Generally, warm forming is the process of deforming metal at an elevated temperature. Warm forming can maximize the metal's malleability but can create its own challenges. In some cases, heating may negatively affect mechanical properties of an aluminum alloy sheet. Heated aluminum alloy sheets may exhibit decreased strength during the stamping operations, and the decreased strength characteristics may persist after cooling of the alloy sheet. Heating of the aluminum alloy sheets also can lead to increased thinning of the aluminum alloy parts during stamping operations. For example, heating of an aluminum alloy facilitates precipitation and dissolution processes within the alloy, which may lead to re-crystallization and grain growth that may change the alloy's structure and negatively affect its mechanical properties. The above processes are known to occur in hardened aluminum alloys, for example, 6XXX series alloys in T6 or T61 temper, leading to decreased strength characteristics.

Heat treatable, age-hardenable aluminum alloys, such as 2XXX, 6XXX and 7XXX aluminum alloys, which are often used for the production of panels in motor vehicles, are typically provided to the manufacturer in the form of an aluminum sheet in a ductile T4 temper, in order to enable the manufacturer to produce desired automotive panels by stamping or pressing. To produce functional motor vehicle parts meeting the required strength specifications, parts produced from an aluminum alloy in T4 temper are typically heat treated post-production and subsequently age hardened, naturally or artificially, to increase their strength. For example, 6XXX aluminum alloys may be artificially aged at the elevated temperature to convert the aluminum alloy into T6 or T61 tempers. Hardened aluminum alloys have decreased formability, which negatively affects the manufacturers' ability to shape them. It is desirable to improve these alloys' formability, for example, by elevating their temperature without negatively affecting their structure and mechanical characteristics.

Accordingly, the manufacturers of aluminum alloy parts are in need of improved warm forming processes for hardened aluminum alloys, such as the alloys in T6 or T61 tempers, to produce the aluminum they use for making parts.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings and each claim.

Disclosed are processes for shaping age hardenable aluminum alloys. The disclosed processes can allow for heat treatment under the disclosed heating parameters to enhance formability of the aluminum alloy, while maintaining the alloys' appropriate strength characteristics. The processes described herein can also limit the thinning of the aluminum alloy parts during stamping.

In some examples, the processes for shaping an article of age-hardenable, heat treatable aluminum alloy include heating the article to a temperature in the range of about 125° C. to about 425° C. at a specified heating rate within the range of about 3° C./s to about 600° C./s, for example about 3° C./s to about 200° C./s or about 3° C./s to about 90° C./s, and second, shaping the article. The heating of the aluminum alloy may be before and/or concurrently with a forming step. In some cases, the heating of the article to a temperature can include heating to a temperature of about 125° C. to about 325° C., about 150° C. to about 250° C., or about 150° C. to about 200° C. Such combinations of the temperature and the heating rate can result in an advantageous combination of the properties of the aluminum alloy sheet or blank, such as a combination of formability and tensile strength in the heated state.

In some cases, the article is a sheet. The article can be, in some cases, 2XXX, 6XXX and 7XXX aluminum alloys. In some cases, the article can be in T6 temper or T61 temper before the heating step. In some cases, the article is in T61 temper after the heating step. In other cases, the article is in T6 temper after the heating step.

In some cases, the heat treatment conducted at heating parameters described herein can enhance formability of the aluminum alloy, while maintaining its strength within acceptable limits and limiting thinning of the aluminum alloy parts during stamping. In some cases, elongation can serve as an indicator of formability; sheets and articles with higher elongation can have good formability. In some cases, the engineering stress of the heated article is 50 to 300 200 MPa, or about 50 to 250 MPa, or about 50 to about 200 MPa. In some cases, according to processes described herein, the elongation of the article can be increased by up to about 3% to about 20% in comparison to the article prior to heating. In some cases, the strength characteristics and the aging capability of the heated aluminum alloy sheet or article can be preserved after the heat treatment.

In some examples, the process for shaping an article can optionally comprise a step of cooling the shaped article. In some cases, the process for shaping an article can optionally include a second shaping step after the cooling step. In some such examples, the elongation of the article resulting from the second shaping step is between about 75% to about 125% (for example, an additional 100%) of the elongation of the heated article resulting from the first shaping step. In some examples, the elongation of an article resulting from a process including a second shaping step can be greater in comparison to elongation of a heated article resulting from a single warm forming step.

In some examples, the heat treatment is accomplished by induction heating, although other heating processes can be employed, as discussed further in more detail. The disclosed processes can be incorporated in the production lines and processes employed in the transportation and motor vehicle industries, for example, the transportation industry for manufacturing of aluminum parts, such as automotive body panels, or parts of trains, airplanes, ships, boats and spacecraft. The disclosed processes are not limited to the automotive industry or, more generally, the motor vehicle industry, and can be advantageously employed in other areas that involve fabrication of aluminum articles.

Other objects and advantages of the invention will be apparent from the following detailed description.

DETAILED DESCRIPTION

Figure 1:
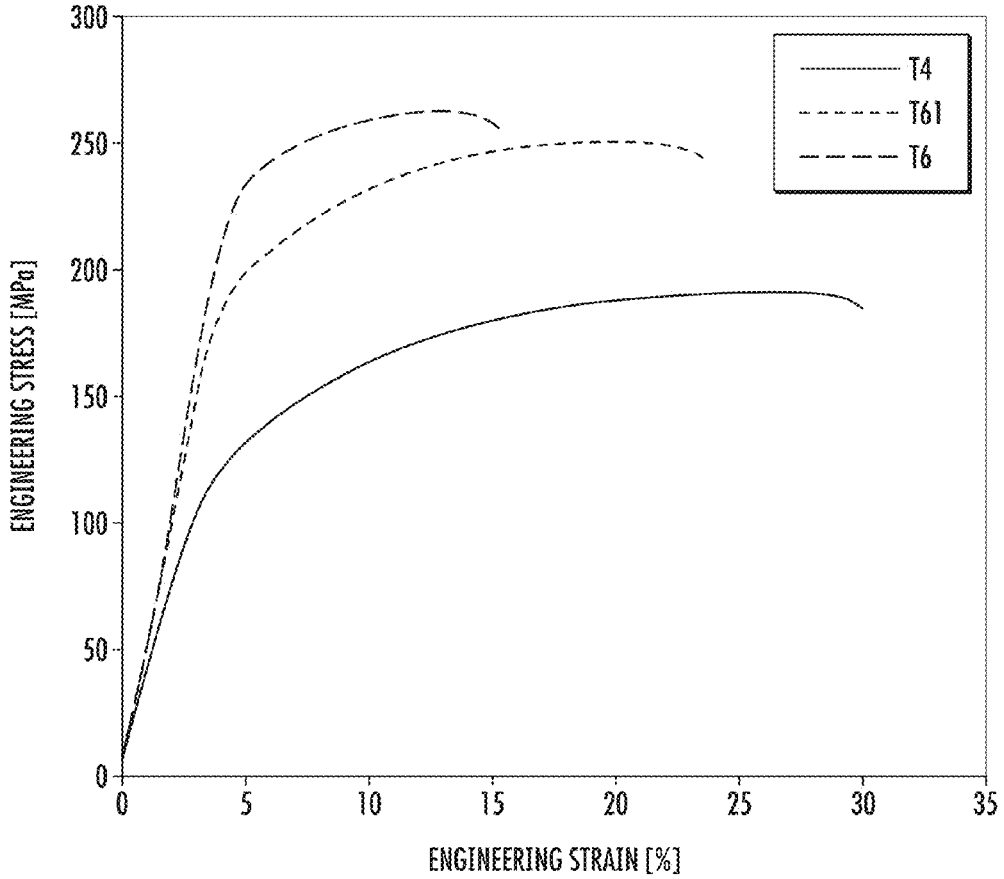
FIG. 1 is a line plot showing stress stain curves of AA6016 alloy samples in different tempers, treated as follows: T4 sample was aged at room temperature for 1 month; T61 sample was obtained from a T4 temper sample by heat treatment at 140° C. for 14 hours; T6 sample was obtained from a T4 sample by heat treatment at 180° C. for 14 hours. Engineering strain (%) is plotted on the X axis. Engineering stress (MPa) is plotted on the Y axis.

The terms "invention," "the invention," "this invention" and "the present invention" used herein are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series" or "7xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," and "the" includes singular and plural references unless the context clearly dictates otherwise.

In the following examples, the aluminum alloys are described in terms of their elemental composition in weight percent (wt. %). In each alloy, the remainder is aluminum, with a maximum wt. % of 0.15% for the sum of all impurities.

Unless other specified herein, room temperature refers to a temperature between about 20° C. to about 25° C., including 20° C., 21° C., 22° C., 23° C., 24° C., or 25° C.

Unless otherwise specified, heat treatment generally refers to heating an alloy sheet or article to a temperature sufficient to warm form the alloy sheet or article. The heat treatment for warm forming can be conducted prior to and/or concurrently with the forming step, so that the forming is performed on the heated aluminum alloy sheet or article.

Aluminum Alloys and Articles

The disclosed processes can be carried out with any aluminum alloy or precipitation hardening aluminum alloy, for example, an aluminum alloy containing Al, Mg, Si and, optionally, Cu, and capable of exhibiting an age-hardening response. Aluminum alloys that can be subjected to the disclosed processes include hardened heat treatable, age-hardenable aluminum alloys (e.g., alloys that may be strengthened by thermal treatment and/or aging), such as 2XXX, 6XXX, and 7XXX series alloys. Non-limiting examples include, AA6010, AA6013, AA6056, AA6111, AA6016, AA6014, AA6008, AA6005, AA6005A, AA6120, AA6170, AA7075, AA7085, AA7019, AA7022, AA7020, AA2013, AA2014, AA2008, AA2014, and AA2017, and AA2024.

Exemplary aluminum alloys may comprise the following constituents besides aluminum (all expressed in weight percent (wt. %)): Si: 0.4-1.5 wt. %, Mg: 0.3-1.5 wt. %, Cu: 0-1.5 wt. %, Mn: 0-0.40 wt. %, and Cr: 0-0.30 wt. %. In another example, the aluminum alloys may comprise the following constituents besides aluminum: Si: 0.5-1.4 wt. %, Mg: 0.4-1.4 wt. %, Cu: 0-1.4 wt. %, Mn: 0-0.35 wt. %, and Cr: 0-0.25 wt. %. In yet another example, the aluminum alloys may comprise the following constituents besides aluminum: Si: 0.6-1.3 wt. %, Mg: 0.5-1.3 wt. %, Cu: 0-1.3 wt. %, Mn: 0-0.30 wt. %, and Cr: 0-0.2 wt. %. In still another example, the aluminum alloys may comprise the following constituents besides aluminum: Si: 0.7-1.2 wt. %, Mg: 0.6-1.2 wt. %, Cu: 0-1.2 wt. %, Mn: 0-0.25 wt. %, and Cr: 0-0.15 wt. %. A composition of an aluminum alloy may affect its response to heat treatment. For example, the strength during or after the heat treatment may be affected by an amount of Mg or of Cu—Si—Mg precipitates present in the alloy.

Suitable aluminum alloys for use in the disclosed methods can be provided in a hardened state. In some cases, hardening to increase strength of aluminum alloys involves at least the following steps: solution heat treatment to achieve dissolution of soluble phases, which occurs when the alloy is heat treated by soaking the alloy at a temperature sufficiently high and for a time long enough to achieve a nearly homogeneous solid solution; quenching to achieve development of supersaturation; and age-hardening to achieve precipitation of solute atoms either at room temperature (natural aging) or elevated temperature (artificial aging or precipitation heat treatment). "Artificial aging" or "artificial age-hardening" (which can be also referred to as "precipitation heat treatment") can refer to a treatment at 115 to 190° C. for 5-48 hours to achieve improvement in strength and hardness properties of the aluminum alloy. "Natural aging" or "natural age-hardening" is aging at room temperature, during which precipitation and a substantially stable state is typically achieved within a period of days.

Suitable aluminum alloys can be provided in T6, T61, or T5 temper. "T6" designation is a temper designation for aluminum alloys where the alloy was solution heat treated and then artificially aged. In comparison, the designation "T4 temper" means that an aluminum alloy was solution heat treated and naturally aged to a substantially stable condition (but was not artificially aged). An aluminum alloy in T6 temper can have lower elongation but higher yield strength than the same alloy in T4 temper. The term "T61 temper" is used herein to denote an intermediate temper between T4 and T6, with higher yield strength but lower elongation than an alloy in T4 temper, and with lower yield strength but higher elongation than in T6 temper. "T5" is a temper designation for aluminum alloys that were cooled from an elevated temperature shaping process and then artificially aged. In some examples of the processes described herein, the aluminum alloy remains in the same temper (for example, T6, T61, or T5) after the heat treatment step as before the heat treatment step.

The aluminum alloy articles that can be subjected to the disclosed warm forming processes can be called a "starting article" or a "starting material" and include sheets, plates, tubes, pipes, profiles, and others as long as the heating rate is achieved. The terms "article," "material," and "part" can be used interchangeably herein. The disclosed warm forming processes may be used on any aluminum article that can be age-hardened and heat treated. An aluminum alloy sheet that may be used as a starting material in the disclosed processes can be produced in a sheet form at a desired thickness (gauge), for example, in a thickness suitable for production of motor vehicle parts. An aluminum alloy sheet can be a rolled aluminum sheet produced from aluminum alloy ingots, billets, slabs, strips, or the like.

Different methods may be employed to make the aluminum sheet or plate provided it is in a hardened state, such as T6, T61, or T5, before the warm forming process. For example, the aluminum alloy sheet can be produced by a process comprising: direct chill casting the aluminum alloy into an ingot; hot rolling the ingot to make a sheet; and, cold rolling the sheet to a final gauge. Continuous casting or slab casting may be employed instead of direct chill casting to make the starting material which is processed into a sheet. The aluminum alloy sheet production process can also include annealing or solution heat treatment, meaning a process of heating the alloy to a suitable temperature and holding it at that temperature long enough to cause one or more constituents to enter into a solid solution, and then cooling it rapidly enough to hold these constituents in solution. In some cases, the aluminum alloy sheet and/or plate can have a thickness of about 0.4 mm to about 10 mm, or from about 0.4 mm to about 5 mm.

The aluminum alloy sheet can be unrolled or flattened prior to performance of the disclosed processes. Aluminum alloy sheet may be sectioned, for example, by cutting into precursor aluminum alloy articles or forms termed "blanks," such as "stamping blanks," meaning precursors for stamping. "Blanks" or "stamping blanks" are included among the articles that can be treated according to the disclosed processes. The term "article" or "material" can refer to the articles provided prior to performing the disclosed processes, to the articles being treated by or subjected to the disclosed processes, as well as to the articles obtained after the disclosed processes, including the articles that were subjected to additional steps or processes. For example, an article may be pre-formed or subjected to other procedures, processes and steps prior to warm forming according to the disclosed processes. In another example, an article may be post-formed or subjected to other procedures, processes and steps after warm forming according to the disclosed processes. An article may formed into a final shape after warm forming using one or more of stamping and/or drawing steps An article may be subjected to post-forming heat treatment or painting after the disclosed processes. In another example, an article may be aged to increase its strength. The aluminum alloy articles produced in the course of performing the disclosed processes, which can be referred to as shaped articles or products, are included within the scope of the invention.

The aluminum alloy articles include two- and three-dimensionally shaped aluminum alloy articles. One example of the alloy article is unrolled or flattened sheet, another example is a flat article cut from a sheet, without further shaping. Another example is a non-planar aluminum alloy article produced by a process that involves one or more three-dimensional shaping steps, such as bending, stamping, pressing, press-forming or drawing. Such a non-planar aluminum alloy article can be referred to as "stamped," "pressed," "press-formed," "drawn," "three dimensionally shaped" or other similar terms. Prior to being shaped according to the disclosed warm forming processes, an aluminum alloy article can be pre-formed by another "warm forming" or a "cold forming" process, step or a combination of steps. "Cold forming" means that no additional heat is applied to the article before or during forming. The aluminum alloy articles produced using the disclosed processes, which can be referred to as shaped articles or products, are included within the examples described herein.

The disclosed processes can be advantageously employed in the transportation and motor vehicle industries, including, but not limited to, automotive manufacturing, truck manufacturing, manufacturing of ships and boats, manufacturing of trains, airplanes and spacecraft manufacturing. Some non-limiting examples of the motor vehicle parts include floor panels, rear walls, rockers, motor hoods, fenders, roofs, door panels, B-pillars, longerons, body sides, rockers or crash members. The term "motor vehicle" and the related terms as used herein are not limited to automobiles and include various vehicle classes, such as, automobiles, cars, buses, motorcycles, marine vehicles, off highway vehicles, light trucks, trucks or lorries. However, aluminum alloy articles are not limited to motor vehicle parts; other types of aluminum articles manufactured according to the processes described in this application are envisioned. For example, the disclosed processes can be advantageously employed in manufacturing of various parts of mechanical and other devices or machinery, including weapons, tools, bodies of electronic devices, and other parts and devices.

Aluminum alloy articles can be comprised of or assembled from multiple parts. For example, motor vehicle parts may be assembled from more than one part (such as an automobile hood, having an inner and an outer panel, or an automobile door, having an inner and an outer panel, or an at least partially assembled motor vehicle body having multiple panels). Furthermore, such aluminum alloy articles comprised of or assembled from multiple parts may be suitable for the disclosed warm forming processes after they are assembled or partially assembled. Also, in some cases, aluminum alloy articles may contain non-aluminum parts or sections, such as parts or sections containing or fabricated from other metals or metal alloys (for example, steel or titanium alloys). In some examples, aluminum alloy articles may have a core and clad structure, with a clad layer on one or both sides of the core layer.

Heating

Shaping aluminum sheets or articles made from such sheets involves heating the alloys, the sheets, or the articles. In some examples, heating the sheets or the articles is performed to a specified temperature or to a temperature within a specified range and at a specified heating rate or at a heating rate within a specified range. Temperatures, heating rates or their ranges, or combinations of those, can be referred to as "heating parameters." In the processes described herein, the sheet or the article is heated to a temperature of about 125-425° C., 150-425° C., 175-425° C., 200-425° C., 225-425° C., 250-425° C., 275-425° C., 300-425° C., 325-400° C., 350-400° C., 375-400° C., 125-375° C., 125-375° C., 150-375° C., 175-375° C., 200-375° C., 225-375° C., 250-375° C., 275-375° C., 300-375° C., 325-375° C., 350-375° C., 125-350° C., 150-350° C., 175-350° C., 200-350° C., 225-350° C., 250-350° C., 275-350° C., 300-350° C., 325-350° C., 125-325° C., 150-325° C., 175-325° C., 200-325° C., 225-325° C., 250-325° C., 275-325° C., 300-325° C., 125-300° C., 150-300° C., 175-300° C., 200-300° C., 225-300° C., 250-300° C., 275-300° C., 125-275° C., 150-275° C., 175-275° C., 200-275° C., 225-275° C., 250-275° C., 125-250° C., 150-250° C., 175-250° C., 200-250° C., 225-250° C., 250-275° C., 125-225° C., 150-225° C., 175-225° C., 200-225° C., 125-200° C., 150-200° C., 175-200° C., 125-175° C., 150-175° C. or 125-150°

C., for example, up to about 150° C., 175° C., 200° C., 225° C., 250° C., 275° C., 300° C., 325° C. or 350° C.

A heating rate of 3-90° C./s, 10-90° C./s, 20-90° C./s, 30-90° C./s, 40-90° C./s, 50-90° C./s, 60-90° C./s, 70-90° C./s or 80-90° C./s may be used in the disclosed methods. In some examples, a heating rate of about 90° C./s is employed. In other examples, a heating rate of about 3° C./s is employed. In some examples, a heating rate of about 3° C./s to about 100° C./s, about 3° C./s to about 110° C./s, about 3° C./s to about 120° C./s, about 3° C./s to about 150° C./s, about 3° C./s to about 160° C./s, about 3° C./s to about 170° C./s, about 3° C./s to about 180° C./s, about 3° C./s to about 190° C./s, or about 3° C./s to about 200° C./s may be employed. In other examples, a heating rate of about 90° C./s to about 150° C./s may be employed. In other examples, a heating rate of about 200° C./s to about 600° C./s may be employed. For example, a heating rate of about 200° C./s to about 250° C./s, 300° C./s, 350° C./s, 400° C./s, 450° C./s, 500° C./s, 550° C./s, or 600° C./s may be employed. One of ordinary skill in the art may adjust the heating rate with available equipment depending on the desired properties of the sheet or article.

Various heating parameters can be employed in the heating processes. In one example, a heating rate of about 90° C./s to a temperature of 125-425° C. is employed. In another example, a heating rate of about 90° C./s to a temperature of 125-325° C. is employed. In yet another example, a heating rate of about 90° C./s to a temperature of 150-250° C. is employed. In another example, a heating rate of about 90° C./s to a temperature of 200-250° C. is employed. In another example, a heating rate of about 3° C./s to a temperature of 200-250° C. is employed. These examples are intended as examples, rather than limiting the different temperatures and heating rates otherwise described herein. The heating parameters are selected based on a variety of factors, such as a desired combination of the properties of the aluminum alloy or aluminum alloy article. The above temperatures and temperature ranges are used to denote "heated to" temperature. In the disclosed processes, the heating process, such as induction heating, is applied to a sheet or article until the "heated to" temperature is achieved. In other words, the "heated to" temperature is the temperature to which the sheet or article is heated prior to the shaping step. The "heated to" temperature may be maintained during the shaping step by an appropriate heating process, or the heating process may be stopped before the shaping step, in which case the temperature of the sheet or article during the shaping step may be lower than the specified "heated to" temperature. The temperature of the sheet or article may or may not be monitored by appropriate procedures and instruments. For example, if the temperature is not monitored, the "heated to" temperature may be a calculated temperature and/or experimentally deduced temperature.

The heating rate can be achieved by choosing an appropriate heat treatment, heating process or system to heat the aluminum alloy sheet. Generally, the heating process or system employed should deliver sufficient energy to achieve the above-specified heating rates. For example, the heating can be accomplished by induction heating. Some other non-limiting examples of heating processes that can be employed are contact heating, resistance heating, infrared radiation heating, heating by gas burner, and direct resistive heating. Generally, design and optimization of the heating system and protocol may be performed to manage heat flow and/or to achieve the desired characteristics of the sheet or article.

Properties

Heating of the sheet or article in the processes as disclosed herein results in an advantageous combination of properties. For example, an advantageous combination of formability and strength properties of the sheet or article is achieved. In some other cases, the sheet can also exhibit advantageously low thinning during shaping. In addition, the sheet or article remains in the same metallurgical state before and after heating and preserves certain properties and behaviors, once cooled, in comparison to the properties possessed by the sheet or article prior to heating.

The disclosed processes enhance the formability of the sheet or article. Formability of a sheet or article is a measure of the amount of deformation it can withstand prior to fracture or excessive thinning. Elongation can serve as an indicator of formability; sheets and articles with higher elongation have good formability. Generally, elongation refers to the extent to which a material can be bent, stretched or compressed before it ruptures. Elongation of a sheet or article and other properties influencing formability, outcome of the shaping process and the quality of the resulting products can be determined by tensile testing.

Tensile testing of samples is conducted according to standard procedures known in the area of material science described in relevant publications, such as those provided by American Society for Testing and Materials (ASTM). ASTM E8/EM8 (DOI: 10.1520/E0008 E0008M-15A) entitled "Standard Test Methods for Tension Testing of Metallic Materials" specifies tensile testing procedures for metallic materials. Briefly, tensile testing is conducted in a standard tensile testing machine known to one of ordinary skill in the art. A sample is typically a flat specimen of standard shape having two shoulders (which can be readily gripped by the machine) and a gauge area of a smaller cross section. During testing, the specimen is placed in the testing machine and extended uniaxially until it fractures, while elongation of the gauge section of the alloy specimen is recorded against the applied force. Elongation is the amount of permanent stretch of a specimen and is measured as the increase in the gauge length of a test specimen. The gauge length of the testing specimen is specified because it influences the elongation value. Some properties measured during tensile testing and used to characterize the aluminum alloy are engineering stress, engineering strain and elongation at fracture. The elongation measurement can be used to calculate "engineering strain," or the ratio of the change in length of the gauge to the original length. Engineering strain can be reported in percent (%). Elongation at fracture, which can also be reported as total elongation, is the amount of engineering strain at fracture of the specimen. Engineering stress is calculated by dividing the load applied to the specimen by the original cross-sectional area of the test specimen. Engineering strain and engineering stress data points can be graphed into a stress-strain curve.

The heating step employed in the disclosed warm forming processes improves elongation of the sheet or article, in comparison to the same sheet or article at room temperature. For example, the heating step may improve elongation of the sheet or article by up to about 10%, by up to about 7.5%, by up to about 5.5%, by up to about 5%, by up to about 4.5%, by up to about 3%, by at least about 2.5%, by at least about 3%, by at least about 3.5%, by about 2.5-10%, by about 3-10%, by about 3.5-10%, by about 4-10%, by about 4.5-10%, by about 5-10%, by about 7.5-10%, by about 2.5-7.5%, by about 3-7.5%, by about 3.5-7.5%, by about 4-7.5%, by about 4.5-7.5%, by about 5-7.5%, by about 2.5-5.5%, by about 3-5.5%, by about 3.5-5.5%, by about 4-5.5%, by about 4.5-5.5%, by about 2.5-5%, by about 2.5-5%, by about 3-5%, by about 3.5-5%, by about 4-5%, by about 4.5-5%, by about 2.5-4.5%, by about 3-4.5%, by about 3.5-4.5%, by about 4-4.5%, by about 2.5-4%, by about 3-4%, by about 3.5-4%, by about 2.5-3.5% or by about 3-3.5%, in comparison to the sheet or article prior to heating. In some cases, the elongation of the sheet or article is improved by about 3, 3.25, 4, 4.25, 4.5, 4.75 or 5%. In some instances, heating of the sheet or article results in elongation (measured as engineering strain) of at least about 10%, at least about 20%, at least about 25%, at least about 30% or up to about 35%, about 15-35%, 20-35%, 25-35%, 30-35%, 15-30%, 20-30%, 25-30%, 15-25%, 20-25%, or 15-20%.

The heating step employed in the disclosed warm forming processes improves elongation of the heated sheet or article while preserving the strength properties (for example, tensile strength, measured as engineering stress) within a range suitable for industrial forming processes. For example, the heated aluminum sheet or article may have an ultimate tensile strength (measured as engineering strain during tensile testing) of at least about 50 MPa, at least about 60 MPa, at least about 70 MPa, at least about 80 MPa, at least about 90 MPa, at least about 100 MPa, at least about 110 MPa, at least about 120 MPa, at least about 130 MPa, at least about 140 MPa, at least about 150 MPa, at least about 160 MPa, at least about 170 MPa, at least about 180 MPa, at least about 190 MPa, at least about 200 MPa, at least about 210 MPa, at least about 220 MPa, at least about 230 MPa, at least about 240 MPa, at least about 250 MPa, at least about 260 MPa, at least about 270 MPa, at least about 280 MPa, at least about 290 MPa, at least about 300 MPa, at least about 310 MPa, at least about 320 MPa, at least about 330 MPa, at least about 340 MPa, at least about 350 MPa, at least about 360 MPa, at least about 370 MPa, at least about 380 MPa, at least about 390 MPa, at least about 400 MPa, at least about 410 MPa, at least about 420 MPa, at least about 430 MPa, at least about 440 MPa, at least about 450 MPa, at least about 460 MPa, at least about 470 MPa, at least about 480 MPa, at least about 490 MPa, at least about 500 MPa, at least about 510 MPa, at least about 520 MPa, at least about 530 MPa, at least about 540 MPa, at least about 550 MPa, at least about 560 MPa, at least about 570 MPa, at least about 580 MPa, at least about 590 MPa, at least about 600 MPa, about 50-200 MPa, about 50-190 MPa, about 50-180 MPa, about 50-170 MPa, about 50-160 MPa about 50-150 MPa, about 50-140 MPa, about 50-130 MPa, about 50-120 MPa, about 50-110 MPa, about 50-100 MPa, about 50-90 MPa, about 50-80 MPa, about 50-70 MPa, about 50-60 MPa, about 60-200 MPa, about 60-190 MPa, about 60-180 MPa, about 60-170 MPa, about 60-160 MPa about 60-150 MPa, about 60-140 MPa, about 60-130 MPa, about 60-120 MPa, about 60-110 MPa, about 60-100 MPa, about 60-90 MPa, about 60-80 MPa, about 60-70 MPa, about 70-200 MPa, about 70-190 MPa, about 70-180 MPa, about 70-170 MPa, about 70-160 MPa about 70-150 MPa, about 70-140 MPa, about 70-130 MPa, about 70-120 MPa, about 70-110 MPa, about 70-100 MPa, about 70-90 MPa, about 70-80 MPa, about 80-200 MPa, about 80-190 MPa, about 80-180 MPa, about 80-170 MPa, about 80-160 MPa about 80-150 MPa, about 80-140 MPa, about 80-130 MPa, about 80-120 MPa, about 80-110 MPa, about 80-100 MPa, about 80-90 MPa, about 90-200 MPa, about 90-190 MPa, about 90-180 MPa, about 90-170 MPa, about 90-160 MPa about 90-150 MPa, about 90-140 MPa, about 90-130 MPa, about 90-120 MPa, about 90-110 MPa, about 90-100 MPa, about 100-200 MPa, about 100-190 MPa, about 100-180 MPa, about 100-170 MPa, about 100-160 MPa, about 100-150 MPa, about 100-140 MPa, about 100-130 MPa, about 100-120 MPa, about 100-110 MPa, about 110-200 MPa, about 110-190 MPa, about 110-180 MPa, about 110-170 MPa, about 110-160 MPa about 110-150 MPa, about 110-140 MPa, about 110-130 MPa, about 110-120 MPa, about 120-200 MPa, about 120-190 MPa, about 120-180 MPa, about 120-170 MPa, about 120-160 MPa about 120-150 MPa, about 120-140 MPa, about 120-130 MPa, about 130-200 MPa, about 130-190 MPa, about 130-180 MPa, about 130-170 MPa, about 130-160 MPa about 130-150 MPa, about 130-140 MPa, 140-200 MPa, about 140-190 MPa, about 140-180 MPa, about 140-170 MPa, about 140-160 MPa about 140-150 MPa, 150-200 MPa, about 150-190 MPa, about 150-180 MPa, about 150-170 MPa, about 150-160 MPa, 160-200 MPa, about 160-190 MPa, about 160-180 MPa, about 160-170 MPa, 170-200 MPa, about 170-190 MPa, about 170-180 MPa, 180-200 MPa or about 180-190 MPa, about 190-200 MPa, about 200-250 MPa, about 200-240 MPa, about 200-230 MPa, about 200-120 MPa, about 200-210 MPa, about 210-250 MPa, about 210-240 MPa, about 210-230 MPa, about 210-220 MPa, about 220-250 MPa, about 220-240 MPa, about 220-230 MPa, about 230-250 MPa, about 230-240 MPa, about 240-250 MPa, about 250-400 MPa, about 250-390 MPa, about 250-380 MPa, about 250-370 MPa, about 250-360 MPa about 250-350 MPa, about 250-340 MPa, about 250-330 MPa, about 250-320 MPa, about 250-310 MPa, about 250-300 MPa, about 250-290 MPa, about 250-280 MPa, about 250-270 MPa, about 250-260 MPa, about 260-400 MPa, about 260-390 MPa, about 260-380 MPa, about 260-370 MPa, about 260-360 MPa about 260-350 MPa, about 260-340 MPa, about 260-330 MPa, about 260-320 MPa, about 260-310 MPa, about 260-300 MPa, about 260-290 MPa, about 260-280 MPa, about 260-270 MPa, about 270-400 MPa, about 270-390 MPa, about 270-380 MPa, about 270-370 MPa, about 270-360 MPa about 270-350 MPa, about 270-340 MPa, about 270-330 MPa, about 270-320 MPa, about 270-310 MPa, about 270-300 MPa, about 270-290 MPa, about 270-280 MPa, about 280-400 MPa, about 280-390 MPa, about 280-380 MPa, about 280-370 MPa, about 280-360 MPa about 280-350 MPa, about 280-340 MPa, about 280-330 MPa, about 280-320 MPa, about 280-310 MPa, about 280-300 MPa, about 280-290 MPa, about 290-400 MPa, about 290-390 MPa, about 290-380 MPa, about 290-370 MPa, about 290-360 MPa about 290-350 MPa, about 290-340 MPa, about 290-330 MPa, about 290-320 MPa, about 290-310 MPa, about 290-300 MPa, about 300-300 MPa, about 300-390 MPa, about 300-380 MPa, about 300-370 MPa, about 300-360 MPa about 300-350 MPa, about 300-340 MPa, about 300-330 MPa, about 300-320 MPa, about 300-310 MPa, about 310-400 MPa, about 310-390 MPa, about 310-380 MPa, about 310-370 MPa, about 310-360 MPa about 310-350 MPa, about 310-340 MPa, about 310-330 MPa, about 310-320 MPa, about 320-400 MPa, about 320-390 MPa, about 320-380 MPa, about 320-370 MPa, about 320-360 MPa about 320-350 MPa, about 320-340 MPa, about 320-330 MPa, about 330-400 MPa, about 330-390 MPa, about 330-380 MPa, about 330-370 MPa, about 330-360 MPa about 330-350 MPa, about 330-340 MPa, 340-400 MPa, about 340-390 MPa, about 340-380 MPa, about 340-370 MPa, about 340-360 MPa about 340-350 MPa, 350-400 MPa, about 350-390 MPa, about 350-380 MPa, about 350-370 MPa, about 350-360 MPa, 360-400 MPa, about 360-390 MPa, about 360-380 MPa, about 360-370 MPa, 370-400 MPa, about 370-390 MPa, about 370-380 MPa, 380-400 MPa or about 380-390 MPa, about 390-400 MPa, about 400-450 MPa, about 400-440 MPa, about 400-430 MPa, about 400-420 MPa, about 400-410 MPa, about 410-450 MPa, about 410-440 MPa, about 410-430 MPa, about 410-420 MPa, about 420-450 MPa, about 420-440 MPa, about 420-430 MPa, about 430-450 MPa, about 430-440 MPa, about 440-450 MPa, about 450-600 MPa, about 450-590 MPa, about 450-580 MPa, about 450-570 MPa, about 450-560 MPa about 450-550 MPa, about 450-540 MPa, about 450-530 MPa, about 450-520 MPa, about 450-510 MPa, about 450-500 MPa, about 450-490 MPa, about 450-480 MPa, about 450-470 MPa, about 450-460 MPa, about 460-600 MPa, about 460-590 MPa, about 460-580 MPa, about 460-570 MPa, about 460-560 MPa about 460-550 MPa, about 460-540 MPa, about 460-530 MPa, about 460-520 MPa, about 460-510 MPa, about 460-500 MPa, about 460-490 MPa, about 460-480 MPa, about 460-470 MPa, about 470-600 MPa, about 470-590 MPa, about 470-580 MPa, about 470-570 MPa, about 470-560 MPa about 470-550 MPa, about 470-540 MPa, about 470-530 MPa, about 470-520 MPa, about 470-510 MPa, about 470-500 MPa, about 470-490 MPa, about 470-480 MPa, about 480-600 MPa, about 480-590 MPa, about 480-580 MPa, about 480-570 MPa, about 480-560 MPa about 480-550 MPa, about 480-540 MPa, about 480-530 MPa, about 480-520 MPa, about 480-510 MPa, about 480-500 MPa, about 480-490 MPa, about 490-600 MPa, about 490-590 MPa, about 490-580 MPa, about 490-570 MPa, about 490-560 MPa about 490-550 MPa, about 490-540 MPa, about 490-530 MPa, about 490-520 MPa, about 490-510 MPa, about 490-500 MPa, about 500-600 MPa, about 500-590 MPa, about 500-580 MPa, about 500-570 MPa, about 500-560 MPa about 500-550 MPa, about 500-540 MPa, about 500-530 MPa, about 500-520 MPa, about 500-510 MPa, about 510-600 MPa, about 510-590 MPa, about 510-580 MPa, about 510-570 MPa, about 510-560 MPa about 510-550 MPa, about 510-540 MPa, about 510-530 MPa, about 510-520 MPa, about 520-600 MPa, about 520-590 MPa, about 520-580 MPa, about 520-570 MPa, about 520-560 MPa about 520-550 MPa, about 520-540 MPa, about 520-530 MPa, about 530-600 MPa, about 530-590 MPa, about 530-580 MPa, about 530-570 MPa, about 530-560 MPa about 530-550 MPa, about 530-540 MPa, 540-600 MPa, about 540-590 MPa, about 540-580 MPa, about 540-570 MPa, about 540-560 MPa about 540-550 MPa, 550-600 MPa, about 550-590 MPa, about 550-580 MPa, about 550-570 MPa, about 550-560 MPa, 560-600 MPa, about 560-590 MPa, about 560-580 MPa, about 560-570 MPa, 570-600 MPa, about 570-590 MPa, about 570-580 MPa, 580-600 MPa or about 580-590 MPa.

Heat treatment conditions in the disclosed warm forming processes may be selected so that that the metallurgical state and the aging behavior and properties of the aluminum sheet or article are preserved. Competition of precipitation and dissolution processes in a hardened aluminum alloy during heating often leads to grain growth and undesirable over-aging, with the attendant loss of strength and hardness. The disclosed processes avoid this problem by employing a specific combination of temperature and heating rate. The heating step disclosed can preserve the strength properties (for example, tensile strength, measured as engineering stress) of the aluminum sheet or article after cooling, optionally followed by an aging period within a range suitable for manufacturing practices. In this situation, the strength properties may be termed "residual." For example, in some cases, the aluminum sheet or article has residual ultimate tensile strength, measured as engineering strain during tensile testing, after cooling by water quenching, followed by one week of age hardening at room temperature of at least about 200 MPa, at least about 225 MPa, at least about 250 MPa, about 200-275 MPa, about 200-250 MPa, about 225-275 MPa or about 225-275 MPa.

The heating step employed in the disclosed warm forming processes can preserve the metallurgical state of the alloy after cooling, optionally followed by age hardening and/or heat treatment, within a range suitable for manufacturing practices. The metallurgical state can be characterized by electrical conductivity, measured according to the standard protocols. ASTM E1004, entitled "Standard Test Method for Determining Electrical Conductivity Using the Electromagnetic (Eddy-Current) Method," specifies the relevant testing procedures for metallic materials. For example, in some cases, the 6XXX aluminum alloy sheet has electrical conductivity of about 25-29 megaSiemens per meter (MS/m), 26-29 MS/m, 27-29 MS/m or 28-29 MS/m, after heat treatment according to the disclosed warm forming processes and cooling by water quenching, followed by one week of age-hardening at room temperature.

The aluminum sheets or articles shaped according to the described processes can combine properties discussed above in various ways. For example, an aluminum alloy subjected to the disclosed processes may have one or more of: elongation of 20.3% at 200° C., ultimate tensile strength of 195 MPa at 200° C. temperature, ultimate tensile strength of 262 MPa after being subjected to heat treatment at 200° C., followed by water quenching and aging for one week at room temperature, and conductivity of 28.7 mS/m after being subjected to heat treatment at 200° C., followed by water quenching and aging for one week at room temperature. Other values or ranges of values, such as those listed earlier in this section, may be displayed by the sheet or article.

Shaping

The disclosed processes may include at least one shaping step during or after the heating step. The term "shaping," as used herein, may include cutting, stamping, pressing, press-forming, drawing or other processes that can create two- or three-dimensional shapes as known to one of ordinary skill in the art. An article made of an age-hardenable, heat treatable aluminum alloy is heated, as discussed earlier in this document, and the heated article is shaped. The above shaping step can be included within a warm forming process. Warm forming can be performed by stamping or pressing. In the stamping or pressing process step, described generally, an article is shaped by pressing it between two dies of complementary shape. Warm forming can be conducted under isothermal or nonisothermal conditions. Under isothermal conditions, the aluminum alloy blank and all the tooling components, such as the dies, are heating to the same temperature. Under non-isothermal conditions, the tooling components may have different temperatures than the blank.

Besides the above warm-forming step, the disclosed processes may include additional shaping steps. For example, prior to warm forming, an aluminum alloy article can be shaped by a combination of one or more of warm forming or cold forming processes or steps. For example, a sheet may be sectioned prior to being subjected to warm forming, for example, by cutting into precursor articles or forms termed "blanks," such as "stamping blanks," meaning precursors for stamping. Accordingly, a step of cutting an aluminum sheet into "stamping blanks" to be further shaped in a stamping press may be utilized. A sheet or a blank may also be shaped by stamping prior to warm forming.

Industrial Processes

The disclosed processes may be incorporated into the existing processes and lines for production of aluminum alloy articles, such as stamped aluminum articles (for example, stamped automotive panels), thereby improving the processes and the resulting articles in a streamlined and economical manner. The apparatuses and the systems for performing the processes and producing the articles described in this document are included within the scope of the present invention.

An exemplary process for producing a stamped aluminum alloy article, such as a motor vehicle panel, includes several (two or more, such as two, three, four, five, six or more) steps of stamping the article on a sequence of stamping presses ("press line"). The process includes one or more heat treatment steps conducted at different process points prior to or during one or more of the stamping steps. A stamping blank is provided before the first stamping step. A heating step may be conducted on a stamping blank before the first stamping step (that is, at the entry of the press line). A heating step may also be included after one or more of the first or intermediate pressing steps. For example, if the pressing line includes five stamping presses and corresponding steps, such a heating step may be included before one or more of the first, second, third, fourth and fifth intermediate stamping steps.

Heating steps may be included in a production process in various combinations, and various considerations may be taken into account when deciding on a specific combination and placement of the heating steps in a production process. For example, a heating step may occur prior to one or more stamping steps in which higher formability is desirable. The process may include one or more warm forming steps and one or more cold forming steps. For example, in a two-step process, an aluminum sheet may be shaped in a warm forming step, followed by a cold forming step. Alternatively, a cold forming step may precede a warm forming step.

Also disclosed are systems for conducting the processes for producing or fabricating aluminum alloy articles that incorporate equipment for practicing the disclosed processes. One exemplary system is a press line for producing stamped articles, such as panels, which incorporates warm forming stations or systems at various points in the line.

The disclosed processes can include additional steps employed in production of aluminum articles, such as cutting, hemming, joining, other heat treatment steps conducted concurrently or post-forming, cooling, age hardening, or steps of coating or painting an article with suitable paint or coating. The processes can include a paint baking step, which can be referred to as "paint baking," "paint bake," "paint bake cycle" or other related terms. Some of the steps employed in the processes of producing or manufacturing an aluminum article, such as post-forming heat treatment steps and a paint bake cycle, may affect the aging of an aluminum alloy from which the article is manufactured and thus affect its mechanical properties, such as strength.

An exemplary process of producing or manufacturing an aluminum article may include the steps of heating an aluminum alloy blank made of hardened heat treatable, age-hardenable aluminum alloy (for example, a blank made of a 6XXX series alloy in T6 or T61 temper) to a temperature of 125-425° C. at a heating rate of about 3-200° C./s, for example about 3-90° C./s or 90° C./s. In some cases, the blank can be shaped, for example, by quickly transferring the blank into a stamping tool, shaping the blank by stamping in the stamping tool, and, after stamping, one or more of steps of cutting, hemming and joining. Another exemplary process of producing or manufacturing an aluminum article may include the steps of heating an aluminum alloy blank made of hardened heat treatable, age-hardenable aluminum alloy (for example, a blank made of a 6XXX series alloy in T6 or T61 temper) to a temperature of 150-250° C. at a heating rate of 3-90° C./s, for example 90° C./s, quickly transferring the blank into a stamping tool, shaping the blank by stamping in the stamping tool, and, after stamping, one or more of steps of cutting, hemming and joining.

In some examples, additional cold forming step or steps may be optionally added after the above described warm forming steps. In some examples, a cold forming step or steps can provide elongation of an article resulting from the cold forming step that is greater in comparison to elongation of a heated article resulting for a single warm forming step. For example, the elongation of the article resulting from the cold forming step can between about 75% to about 125% of the elongation of the heated article resulting from the first warm forming step. In some examples, the elongation from the cold forming step can be about 75%, 80%, 85%, 90%, 95%, 100%, 105%, 110%, 115%, 120% or 125% of the first warm forming step, resulting in a total elongation of the article that can be greater than the total elongation of an article subjected to a single warm forming step. Example 6 below provides experimental data showing the increased elongation. An optional post-forming heat treatment step may also be added.

The following examples will serve to further illustrate the present invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention.

EXAMPLE 1

Figure 2:
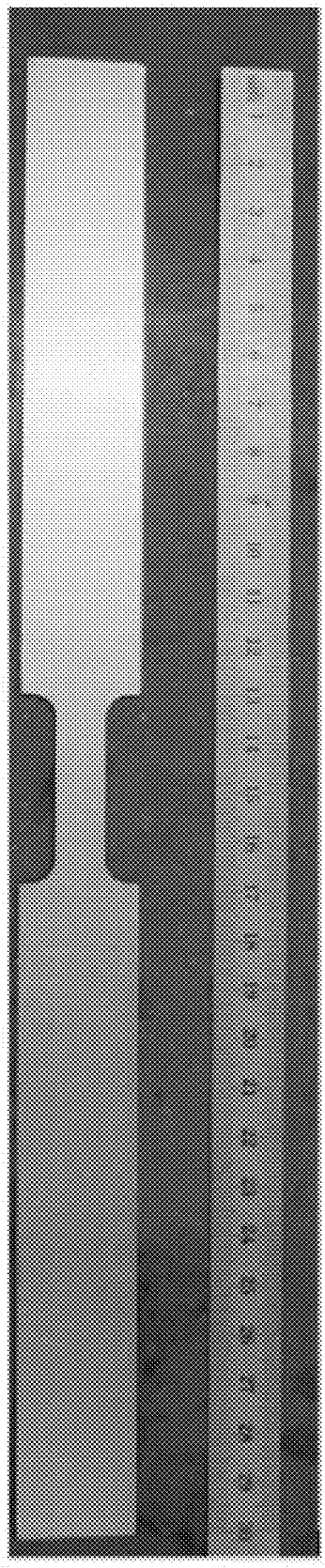
FIG. 2 is a photograph of a sample aluminum alloy specimen used for tensile testing.

Room Temperature Tensile Testing of AA6016 Alloy Samples in T4, T61 and T6 Tempers Room temperature tensile testing of AA6016 aluminum alloy samples in T4, T61 and T6 tempers was performed. The stress-strain curves obtained by the tensile testing are shown in FIG. 1. Testing samples were the specimens of AA6016 alloys shaped as shown in FIG. 2. The specimens had a thickness of 1.2 mm. The specimens were treated as follows: "T4" sample—aged at room temperature for 1 month; "T61" sample—T4 temper sample heat treated at 140° C. for 14 hours; "T6" sample—T4 sample heat treated at 180° C. for 14 hours. The stress-strain curves shown in FIG. 1 show the differences in strength and formability among the three tempers.

EXAMPLE 2

Elevated Temperature Tensile Testing of AA6016

Figure 3:
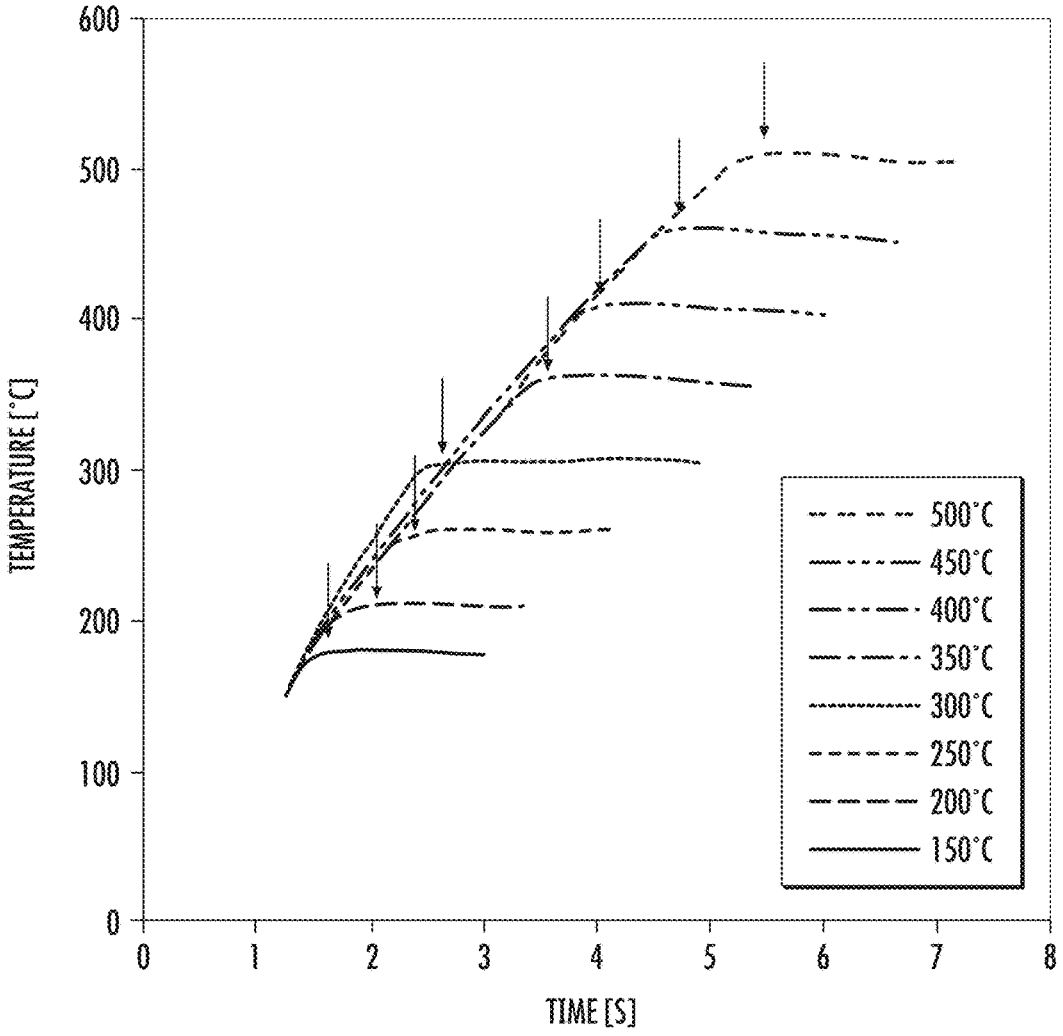
FIG. 3 is a line plot showing heating curves of AA6016 alloy samples in T4 temper heated to various temperatures (as indicated) by induction heating at a rate of 90° C./s. Arrows indicate the start of tensile testing. Time (seconds) is plotted on the X axis. Temperature (° C.) is plotted on the Y axis.

Elevated temperature tensile testing of AA6016 aluminum alloy samples was performed. For elevated temperature testing, the specimens, substantially similar to the specimen shown in FIG. 2 and having a thickness of 1.2 mm, were heated to various temperatures (as indicated in FIG. 3) by induction heating at a rate of 90° C./s. A pyrometer was used to measure the temperature of each specimen. The specified testing temperature of each specimen was maintained during the tensile testing. FIG. 3 shows heating curves of AA6016 aluminum alloy samples in T4 temper before and during the tensile testing, with arrows indicating the start of tensile testing once the specimens achieved the target temperature.

Heating curves for AA6016 aluminum alloy samples in T6 or T61 temper were similar to FIG. 3 (not shown, as heating the samples is independent of the sample temper).

Figure 4:
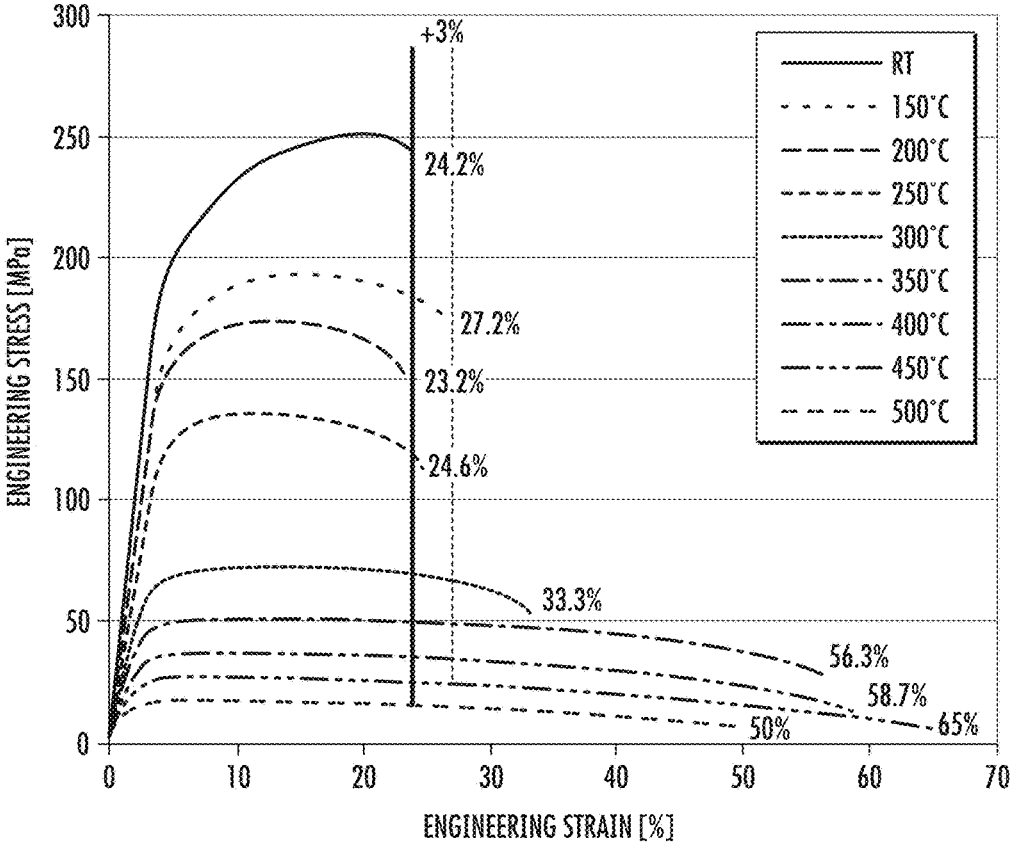
FIG. 4 is a line plot showing stress-strain curves of AA6016 alloy samples in T61 temper heated to various temperatures (as indicated) by induction heating at a rate of 90° C./s. A stress-strain curve of an AA6016 alloy sample at room temperature ("RT") is also shown. The vertical solid line represents total elongation of the room temperature (RT) sample. The vertical dotted line represents an increase in total elongation of 3%, in comparison to the total elongation of the room temperature sample. Elongation percentages at each temperature are shown. Engineering strain (%) is plotted on the X axis. Engineering stress (MPa) is plotted on the Y axis.
Figure 5:
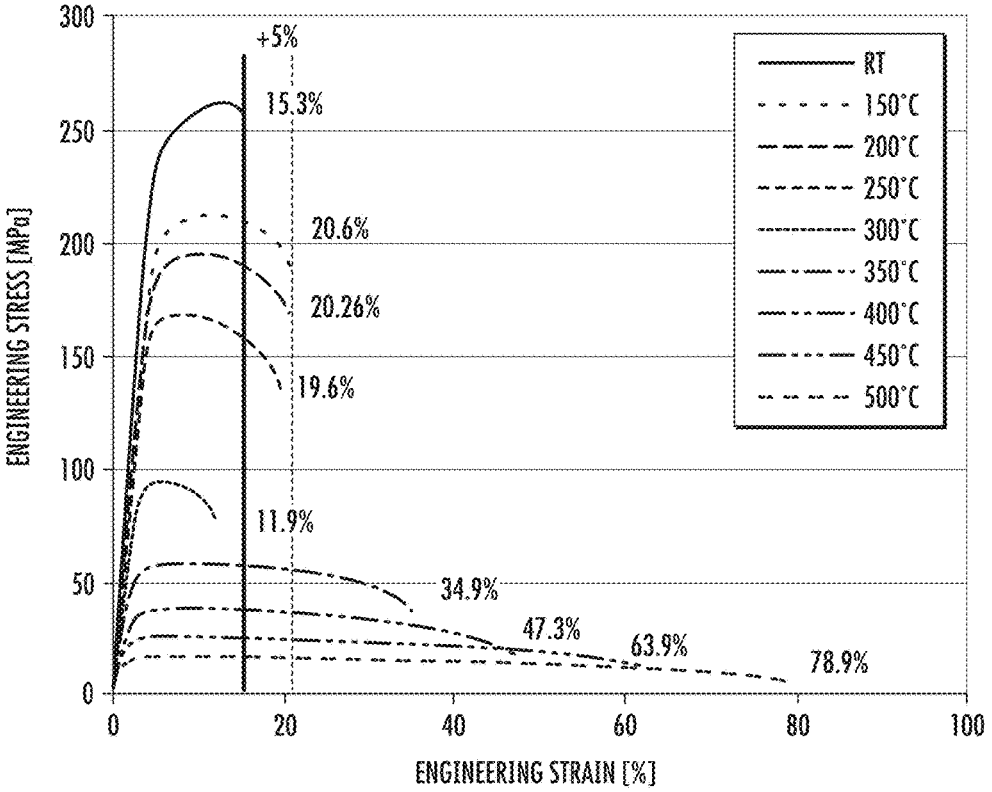
FIG. 5 is a line plot showing stress-strain curves of AA6016 alloy samples in T6 temper heated to various temperatures (as indicated) by induction heating at a rate of 90° C./s. A stress-strain curve of an AA6016 alloy sample at room temperature ("RT") is also shown. The vertical solid line represents total elongation of the room temperature (RT) sample. The vertical dotted line represents an increase in total elongation of 5%, in comparison to the total elongation of the room temperature sample. Elongation percentages at each temperature are shown. Engineering strain (%) is plotted on the X axis. Engineering stress (MPa) is plotted on the Y axis.

FIG. 4 shows stress-strain curves of AA6016 alloy samples in T61 temper heated to various temperatures (as indicated) by induction heating at a rate of 90° C./s. A stress-strain curve of an AA6016 alloy sample at room temperature ("RT") is also shown. The vertical solid line represents the total elongation of the room temperature (RT) sample. The vertical dotted line represents an increase in total elongation of 3%, in comparison to the total elongation of the room temperature sample. FIG. 5 shows stress-strain curves of AA6016 alloy samples in T6 temper heated to various temperatures (as indicated) by induction heating at a rate of 90° C./s. A stress-strain curve of an AA6016 alloy sample at room temperature ("RT") is also shown. The vertical solid line represents the total elongation of the room temperature (RT) sample. The vertical dotted line represents an increase in total elongation of 5%, in comparison to the total elongation of the room temperature sample. Tensile testing showed that heating the AA6016 alloy samples to the temperatures of 150-250° C. may result in a 3-5% increase in total elongation, in comparison to the total elongation exhibited by the AA6016 specimen in the same temper at room temperature (RT). As shown in FIG. 4, heating an AA6016 alloy sample in T61 temper to 300° C. resulted in about 33.3% increase in total elongation. Tensile testing showed that an advantageous increase in total elongation for alloy samples in T6 or T61 temper can be achieved while maintaining strength properties acceptable for warm forming.

EXAMPLE 3

Post Heat Treatment Tensile Testing

Post heat treatment tensile testing of AA6016 aluminum alloy samples in T6 and T61 tempers was performed. Testing samples were the specimens of AA6016 alloy samples shaped as illustrated in FIG. 2. The samples had a thickness of 1.2 mm. For post heat treatment testing, the samples were heated to various temperatures by induction heating at a rate of 90° C./s, cooled in water ("water quenched"), and, subsequent to water quenching, aged for 1 week at room temperature. The tensile testing was conducted at room temperature. A sample of AA6016 maintained at room temperature ("RT" in FIGS. 6-7) was also tested for comparison.

Figure 6:
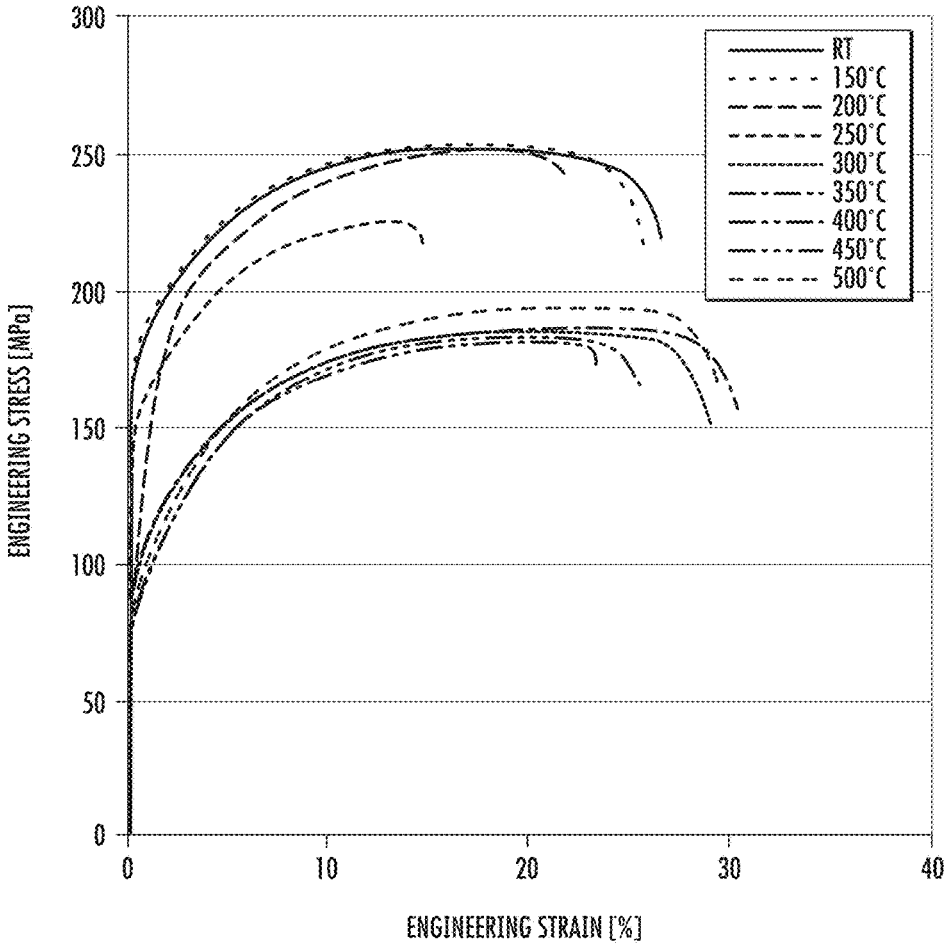
FIG. 6 is a line plot showing stress-strain curves of AA6016 alloy samples in T61 temper heated to various temperatures (as indicated) by induction heating at a rate of 90° C./s, water quenched, and, subsequent to water quenching, aged for 1 week at room temperature. The tensile test was conducted at room temperature. A stress-strain curve of an AA6016 alloy sample maintained at room temperature ("RT") is also shown. Engineering strain (%) is plotted on the X axis. Engineering stress (MPa) is plotted on the Y axis.
Figure 7:
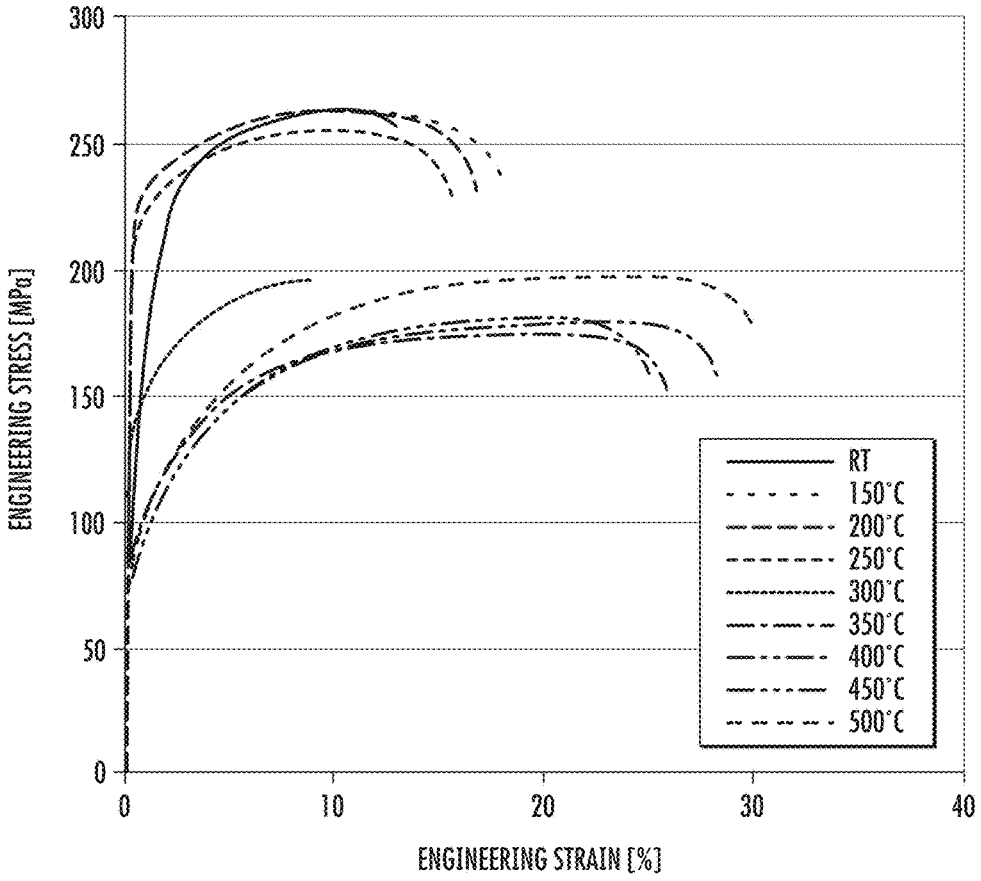
FIG. 7 is a line plot showing stress-strain curves of AA6016 alloy samples in T6 temper heated to various temperatures (as indicated) by induction heating at a rate of 90° C./s, water quenched, and, subsequent to water quenching, aged for 1 week at room temperature. The tensile test was conducted at room temperature. A stress-strain curve of an AA6016 alloy sample maintained at room temperature ("RT") is also shown for comparison purposes. Engineering strain (%) is plotted on the X axis. Engineering stress (MPa) is plotted on the Y axis.

FIG. 6 shows stress-strain curves of post heat treatment AA6016 samples in T61 temper. FIG. 7 shows stress-strain curves of post heat treatment AA6016 samples in T6 temper. Post-heat treatment stress-strain curves for the samples treated at 150, 200 and 250° C. were of substantially similar shape and magnitude, and are also similar to the stress-strain curve of the room temperature (RT) sample. The stress-strain curves shown in FIGS. 6 and 7 demonstrate that the heat treatment used in the experiment did not substantially alter the residual mechanical properties of AA6016 samples. In addition, the above-described data show that performing a cold forming step after a warm forming step increases the total forming potential, in this case, almost doubling the total forming potential.

EXAMPLE 4

Figure 8:
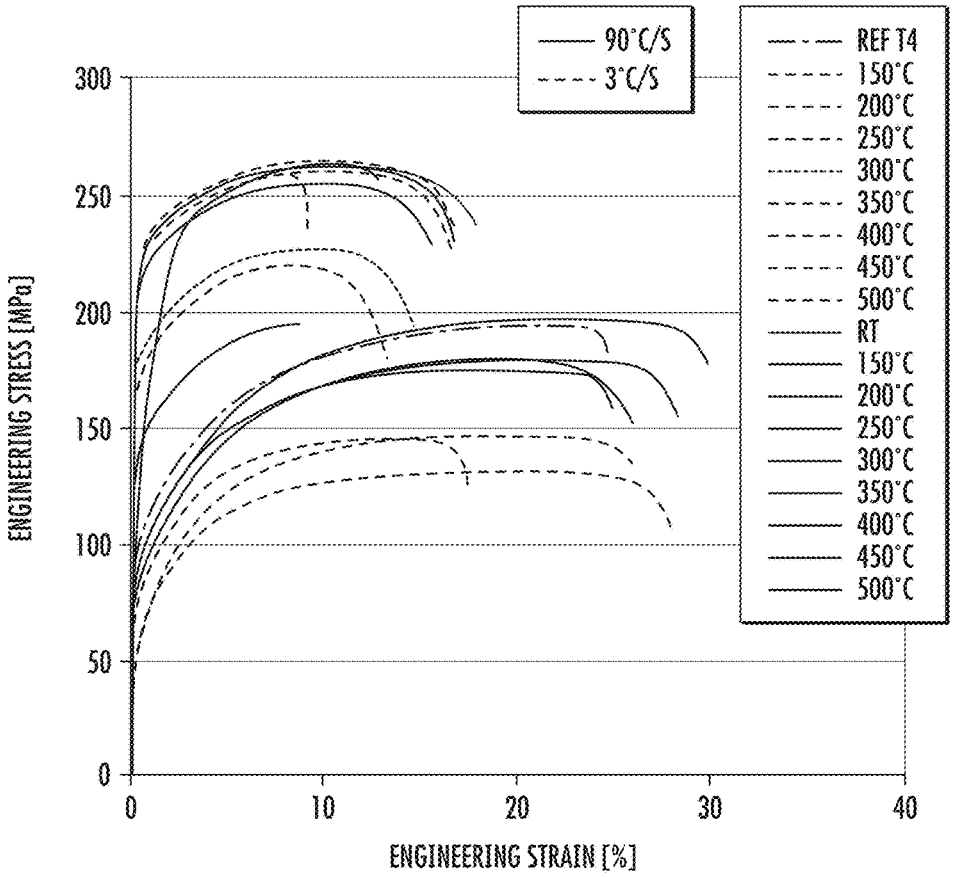
FIG. 8 is a line plot showing stress-strain curves of AA6016 alloy samples in T6 temper heated to various temperatures (as indicated) by induction heating at rates of 90° C./s or 3° C./s, water quenched, and, subsequent to water quenching, aged for 1 week at room temperature. The tensile test was conducted at room temperature. A stress-strain curve of an AA6016 alloy sample maintained at room temperature ("RT") and of an AA6016 alloy sample in T4 temper ("Ref T4") are also shown. Engineering strain (%) is plotted on the X axis. Engineering stress (MPa) is plotted on the Y axis.

Post Heat Treatment Tensile Testing of Samples Heated at Different Heating Rates Tensile testing of AA6016 alloy samples in T6 temper heated at different heating rates was performed. Testing samples were the samples of AA6016 illustrated in FIG. 2. The samples each had a thickness of 1.2 mm. For post heat treatment testing, the samples were heated to various temperatures by induction heating at a rate of 3° C./s (identified curves in FIG. 8 and left histogram in each set in FIG. 9), or 90° C./s (identified curves in FIG. 8 and right histogram in each set in FIG. 9), cooled in water ("water quenched") and aged for 1 week at room temperature. An AA6016 alloy sample maintained at room temperature ("RT" in FIG. 8) was also tested for comparison. FIG. 8 shows stress-strain curves of thus treated AA6016 samples tested at room temperature. The stress-strain curve of the AA6016 alloy sample maintained at room temperature is also shown (referred to as "REF T4" in the graph).

Figure 9:
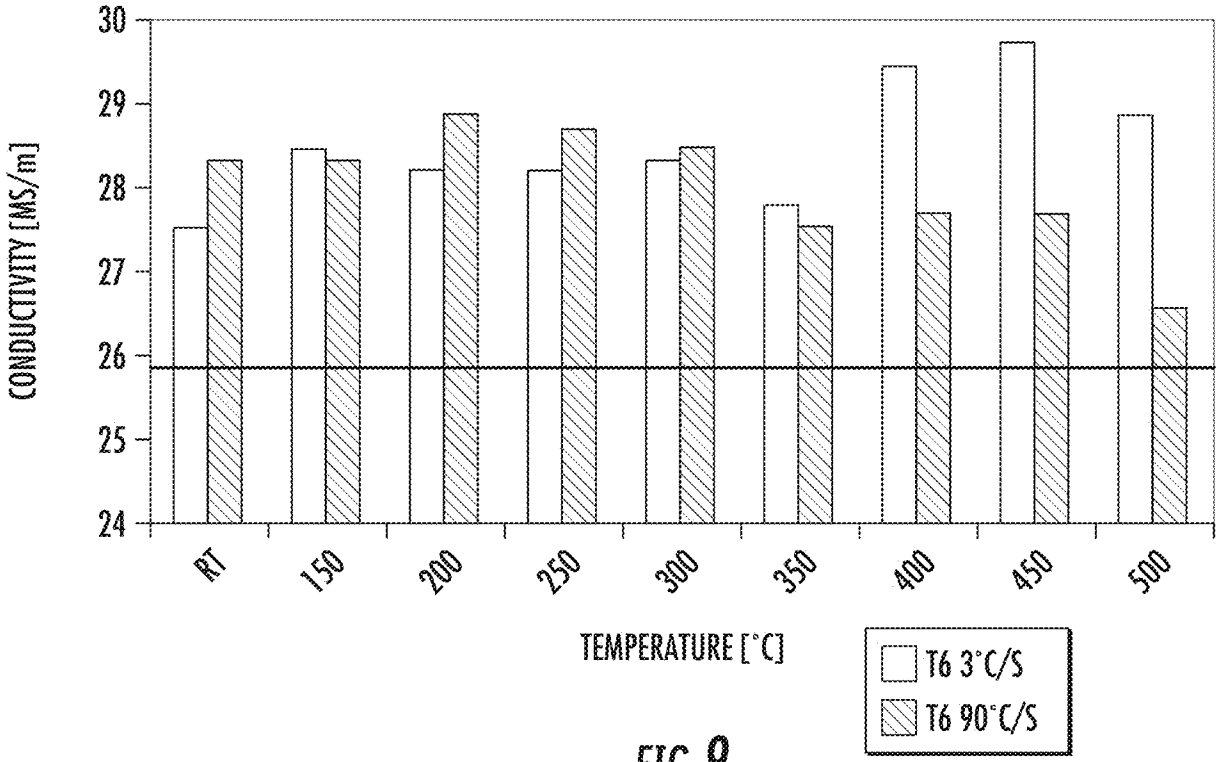
FIG. 9 is a bar graph showing the results of comparative electrical conductivity measurements of AA6016 alloy samples after warm forming heat treatment. Prior to the conductivity measurement, samples in T6 temper were heated to various temperatures (as indicated) by induction heating at rates of 90° C./s (right histogram bar of each pair) and 3° C./s (left histogram bar of each pair), water quenched, and subsequently aged for 1 week at room temperature. The horizontal line indicates the conductivity level expected from AA6016 samples in T4 temper. Temperature (° C.) is plotted on the X axis. Conductivity (MS/m) is plotted on the Y axis.
Figure 10:
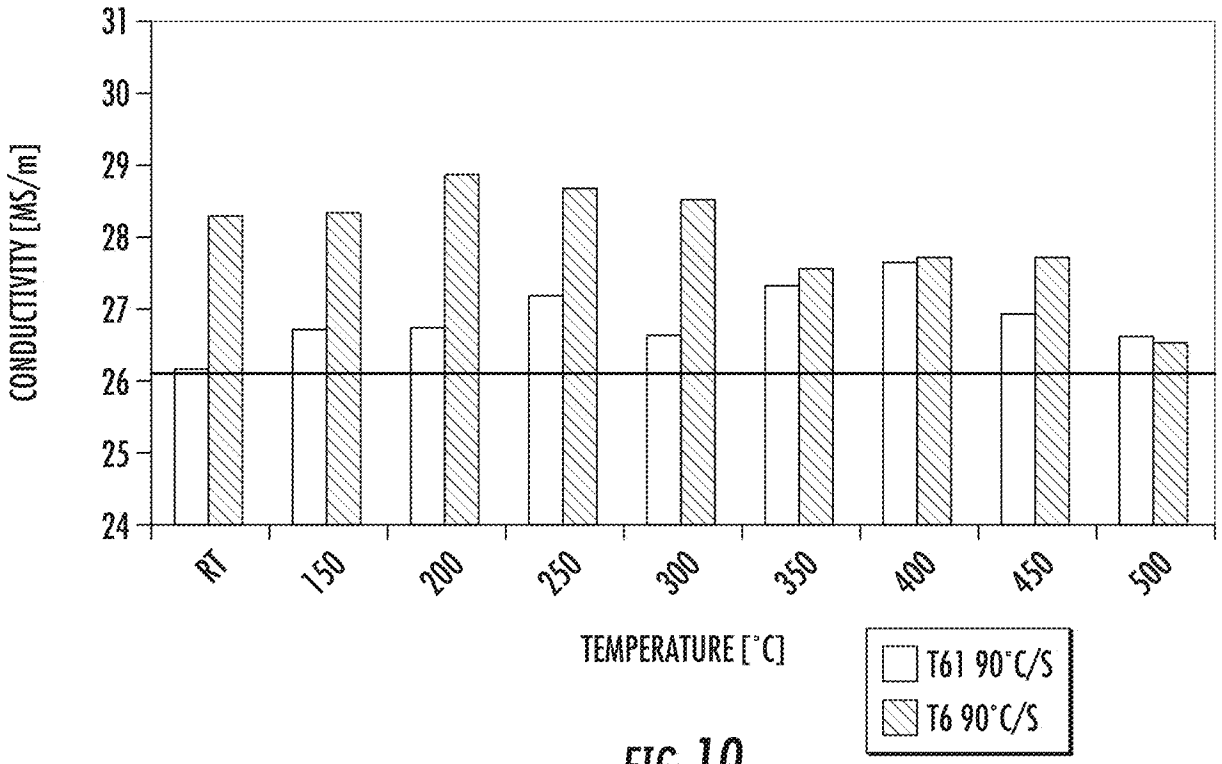
FIG. 10 is a bar graph showing the results of comparative electrical conductivity measurements of AA6016 alloy samples after warm forming heat treatment. Prior to a conductivity measurement, samples in T61 temper (left histogram bar of each pair) and T6 temper (right histogram bar of each pair) were heated to various temperatures (as indicated) by induction heating at a rate of 90° C./s, water quenched, and subsequently aged for 1 week at room temperature. The horizontal line indicates the conductivity level expected from AA6016 samples in T4 temper. Temperature (° C.) is plotted on the X axis. Conductivity (MS/m) is plotted on the Y axis.
Figure 11:
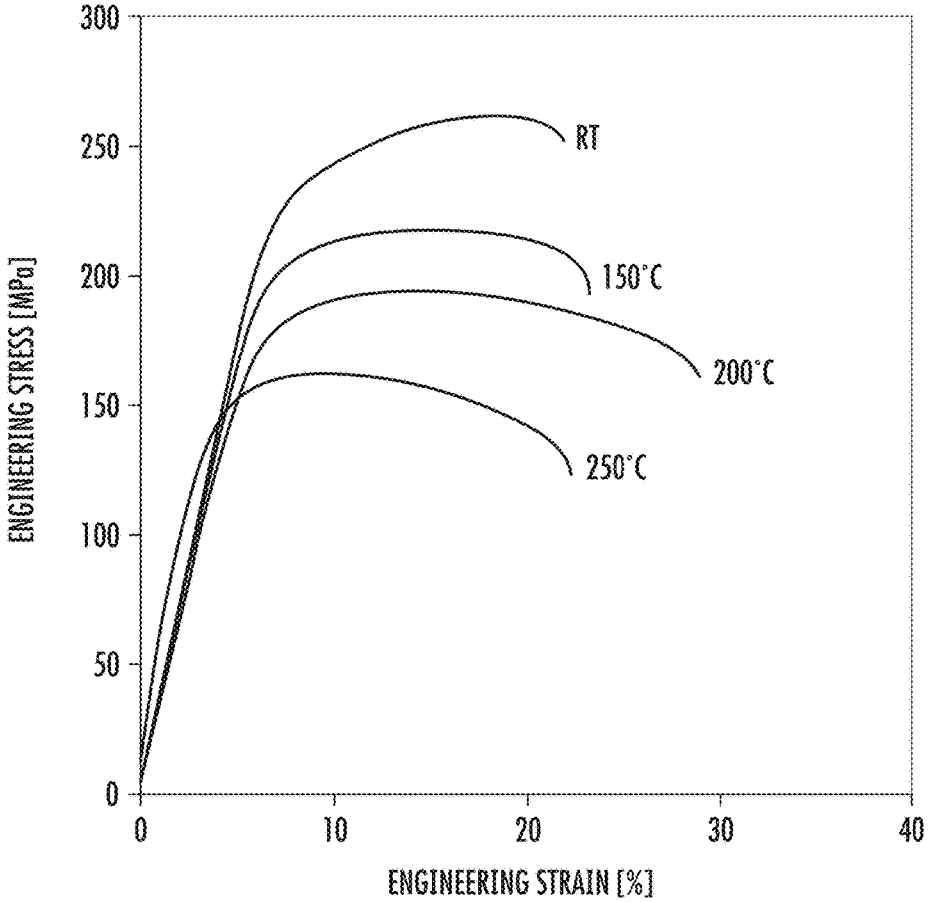
FIG. 11 is a line graph showing stress-strain curves of heated AA6016 alloy samples in T6 temper heated to various temperatures (as indicated) by induction heating at rate of 3° C./s. The tensile tested was conducted at the indicated temperature. A stress-strain curve of an AA6016 alloy sample at room temperature is also shown ("RT"). Engineering strain (%) is plotted on the X axis. Engineering stress (MPa) is plotted on the Y axis.

FIG. 9 is a bar graph showing the results of comparative electrical conductivity measurements of AA6016 alloy samples treated in the same manner as the samples used in the experiments to generate FIG. 8. Samples in T6 temper were heated to various temperatures (as indicated) by induction heating at rates of 3° C./s (left histogram bar of each pair) and 90° C./s (right histogram bar of each pair), water quenched, and subsequently aged for 1 week at room temperature. The horizontal line indicates the conductivity level expected from AA6016 samples in T4 temper. FIG. 10 is a bar graph showing the results of comparative electrical conductivity measurements of AA6016 alloy samples in T61 temper (left histogram bar in each set) and T6 temper (right histogram bar in each set) treated at various temperatures (as indicated) by induction heating at a rate of 90° C./s, cooled in water ("water quenched") and aged for 1 week at room temperature. FIG. 11 shows stress-strain curves of heated AA6016 alloy samples tested at various temperatures (as indicated) by induction heating at a rate of 3° C./s.

The experimental data illustrated in FIGS. 8 and 9 demonstrate that the heating rate affected the mechanical characteristics and the metallurgical state of AA6016 alloy samples. Elongation improvement without the loss of strength occurred in a wider range of temperatures when the higher heating rate of 90° C./s was employed. Correlating with this observation, heating at the lower rate of 3° C./s led to a change in metallurgical state (as indicated by the conductivity measurement) of the samples heat-treated at the higher temperatures. The experimental data in FIG. 10 show greater differences in metallurgical state between the samples in T6 and T61 temper that were heat-treated at the lower temperatures (e.g., from room temperature to 300° C.) as compared to the samples in T6 and T61 temper that were heat-treated at the higher temperatures (e.g., from 350° C. to 500° C.).

EXAMPLE 5

Laboratory Scale Stamping

Aluminum alloy AA6016 sheets (2 mm thickness) in T6 temper were cut to 40 cm by 10 cm stamping blanks. The rectangular pieces were optionally heated according to warm forming methods described herein. Four samples were used for the stamping experiment. Sample 1 was not heated and stamped at room temperature (about 25° C.). Sample 2 was heated to 200° C. Sample 3 was heated to 250° C. Sample 4 was heated to 350° C. Test parameters and results are presented in Table 1.

TABLE 1

| Sample No. | Preheat Temperature ° C. | Draw Depth mm | Result | Brinell Hardness HB5 |
|---|---|---|---|---|
| 1 | N/A | 40 | Failure | 103 |
| 2 | 200 | 40 | Did not fail | 100 |
| 3 | 250 | 40 | Did not fail | 76 |
| 4 | 350 | 40 | Did not fail | 54 |

Figure 12:
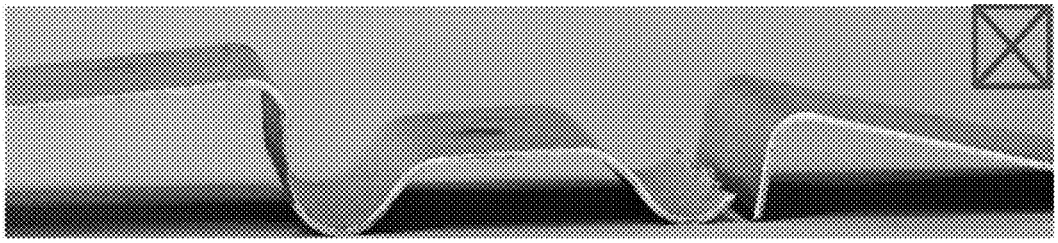
FIG. 12 is a photograph of a stamped alloy used for testing. The alloy shown in FIG. 12 was stamped at room temperature and failed during forming.
Figure 13:
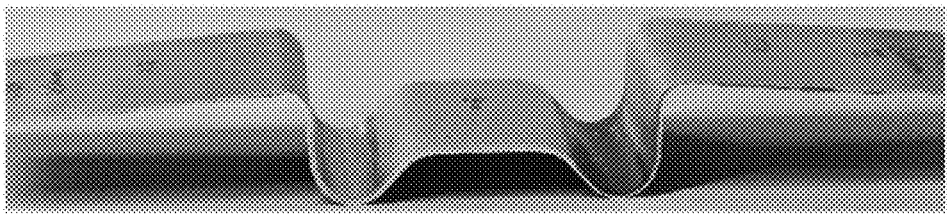
FIG. 13 is a photograph of a stamped alloy used for testing. The alloy shown in FIG. 13 was preheated to 200° C. and did not fail during forming.
Figure 14:
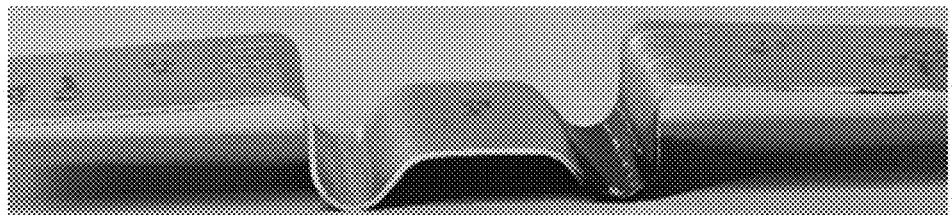
FIG. 14 is a photograph of a stamped alloy used for testing. The alloy shown in FIG. 14 was preheated to 250° C. and did not fail during forming.
Figure 15:
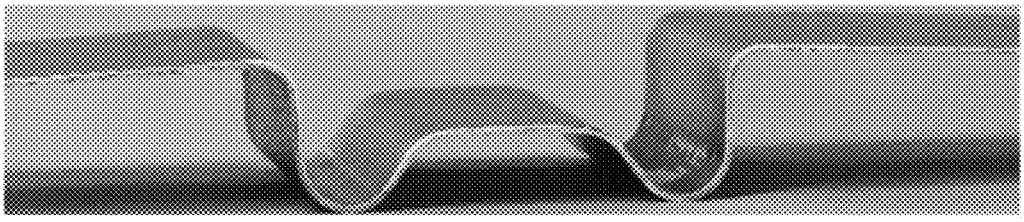
FIG. 15 is a photograph of a stamped alloy used for testing. The alloy shown in FIG. 15 was preheated to 350° C. and did not fail during forming.

Sample 1 was drawn to a depth of 40 mm and exhibited cracking and ultimate failure, as shown in FIG. 12. Sample 2 was preheated to 200° C. and drawn to a depth of 40 mm and did not fail, as shown in FIG. 13. Sample 3 was preheated to 250° C. and drawn to a depth of 40 mm and did not fail, as shown in FIG. 14. Sample 4 was preheated to 350° C. and drawn to a depth of 40 mm and did not fail, as shown in FIG. 15. The Brinell hardness of all samples was measured after stamping following ISO 6506-1 standards.

The stamping results suggest parts can safely be produced after the alloy was preheated. The formability of the sheets is characterized by the achievable draw depth without cracking of the stamped part. The strength of the sheets (exemplified by the hardness results) is conserved at 200° C., slightly decreased when preheated to 250° C. (but still acceptable) and significantly decreased when preheated to higher temperatures.

EXAMPLE 6

Two-Step Stamping Procedure for Deeper Draw Depth in Preheated Alloys

Aluminum alloy AA6016 sheets (2 mm thickness) in T6 temper were cut to 40 cm by 10 cm stamping blanks. In the first step of the two-step stamping procedure, the rectangular pieces were heated according to warm forming methods described herein. Three samples were used for the stamping experiment. Sample 5 was heated to 200° C. Sample 6 was heated to 250° C. Sample 7 was heated to 350° C. Sample 1 from Example 5 is included as reference. Test parameters and results are presented in Table 2.

TABLE 2

| Sample No. | Preheat Temperature ° C. | Draw Depth #1 Warm mm | Draw Depth #2 Room Temperature mm | Result | Brinell Hardness HB5 |
|---|---|---|---|---|---|
| 1 | N/A | N/A | 40 | Failure | 103 |
| 5 | 200 | 40 | 40 | Did not fail | 96 |
| 6 | 250 | 40 | 40 | Did not fail | 78 |
| 7 | 350 | 40 | 40 | Did not fail | 55 |

Figure 16:
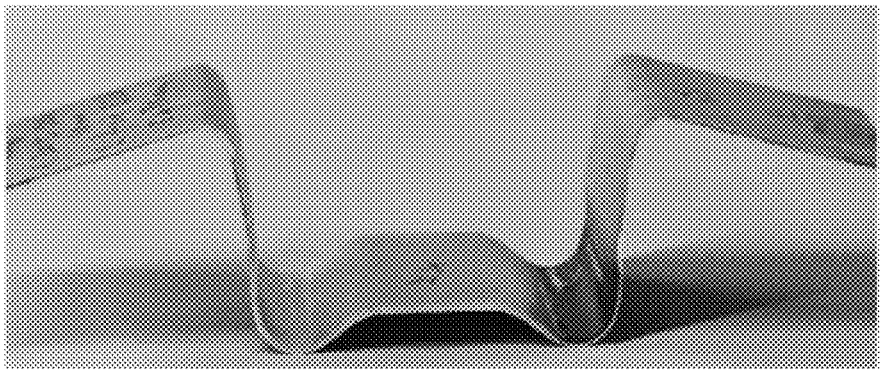
FIG. 16 is a photograph of a stamped alloy used for testing. The alloy shown in FIG. 16 was preheated to 200° C. and did not fail during forming.
Figure 17:
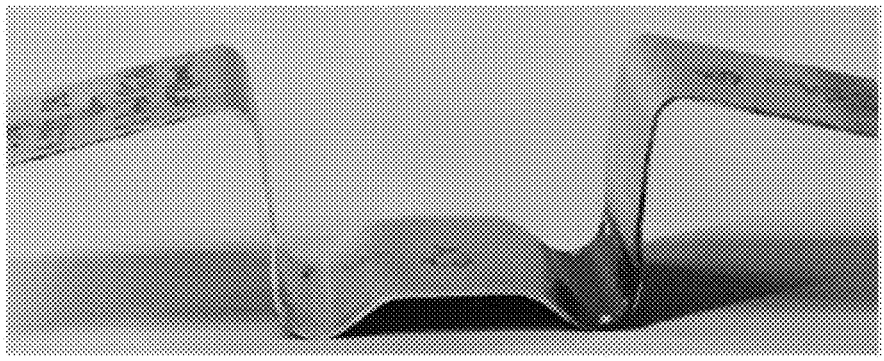
FIG. 17 is a photograph of a stamped alloy used for testing. The alloy shown in FIG. 17 was preheated to 250° C. and did not fail during forming.
Figure 18:
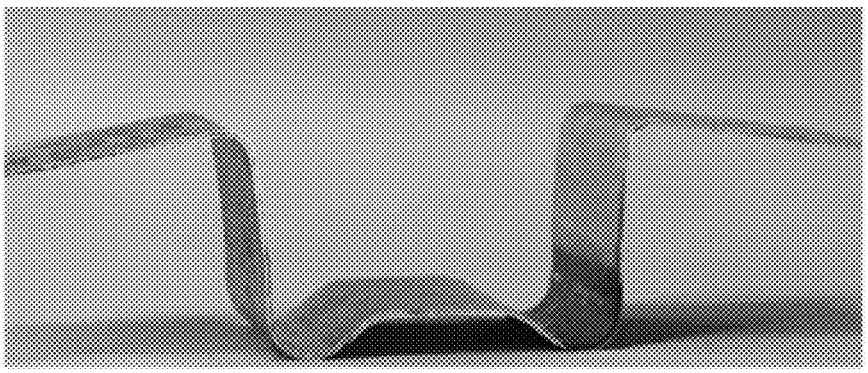
FIG. 18 is a photograph of a stamped alloy used for testing. The alloy shown in FIG. 18 was preheated to 350° C. and did not fail during forming.

Sample 1 was drawn to a depth of 40 mm and exhibited cracking and ultimate failure, as shown in FIG. 12. Sample 5 was preheated to 200° C. and drawn to a depth of 40 mm and did not fail. Sample 5 was allowed to cool to room temperature and drawn an additional 40 mm to a total draw depth of 80 mm and did not fail, as shown in FIG. 16. Sample 6 was preheated to 250° C. and drawn to a depth of 40 mm and did not fail. Sample 6 was allowed to cool to room temperature and drawn an additional 40 mm to a total draw depth of 80 mm and did not fail, as shown in FIG. 17. Sample 7 was preheated to 350° C. and drawn to a depth of 40 mm and did not fail. Sample 7 was allowed to cool to room temperature and drawn an additional 40 mm to a total draw depth of 80 mm and did not fail, as shown in FIG. 18. The Brinell hardness of all samples was measured after stamping following ISO 6506-1 standards.

Figure 19:
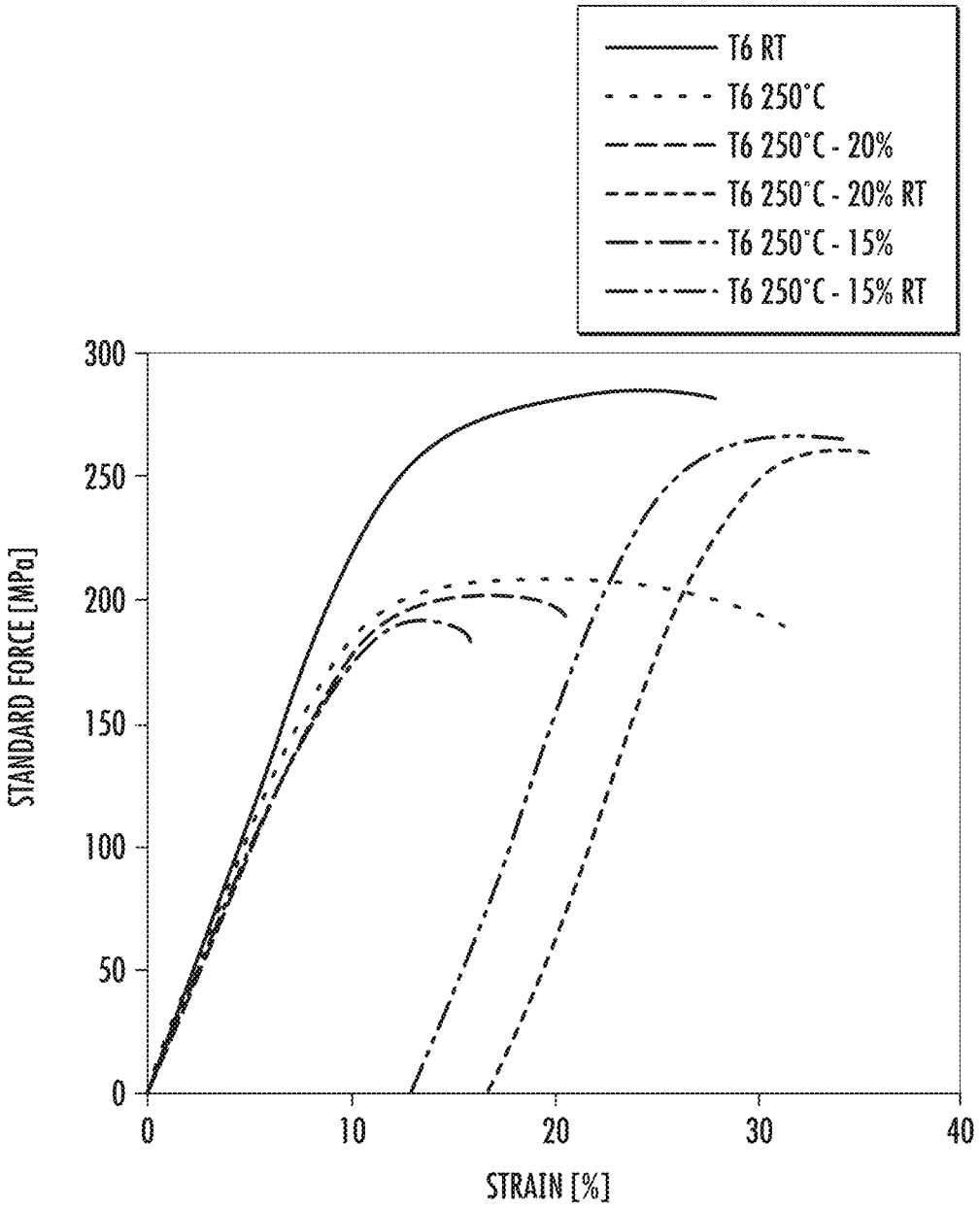
FIG. 19 is a line plot showing the tensile strength test results of the preheated and formed alloy samples described in Examples 5 and 6.

Stamping to a draw depth of 40 mm at room temperature is not possible without preheating the alloys (see FIG. 12). Performing a two-step procedure can allow for stamping to at least 80 mm draw depth while maintaining the T6 strength if the preheat temperature is chosen appropriately. The stamping results described in Example 6 and shown in FIGS. 12 and 16-18 are consistent with the elongation measured from the tensile curves presented in FIG. 19 for different samples preheated to 250° C. For example, as shown in FIG. 19, the tensile curve for the samples where the disclosed two-step forming process was performed shows a higher engineering strain value (x-axis) as compared to the tensile curve for both a sample maintained at room temperature (referred to as "RT" in FIG. 19) and a sample where only a one-step forming process was performed (referred to as "T6 250° C."). The engineering strain value for the sample maintained at room temperature was about 29%, and the engineering strain for the sample formed in a single warm forming step was about 31%. FIG. 19 also shows ultimate engineering strain values of about 34% and 35% for the two samples that were formed by the two-step process. The first forming step is represented by the curves referred to as "T6 250° C.—15%" and "T6 250° C.—20%," for the samples initially strained to about 15% and about 20%, respectively. The pre-strained samples were further strained at room temperature (represented by curves referred to as "T6 250° C.—15% RT" and "T6 250° C.—20% RT") as a second forming step. The pre-straining to about 13% (T6 250° C.—15% RT) and 17% (T6 250° C.—20% RT) allowed for the resulting ultimate strain values.

All patents, patent applications, publications, and abstracts cited above are incorporated herein by reference in their entirety. Various examples of the invention have been described in fulfillment of the various objectives of the invention. These examples are merely illustrative of the principles of the present invention. Numerous modifications and adaptations thereof will be readily apparent to those of skill in the art without departing from the spirit and scope of the invention as defined in the following claims.

What is claimed is:

1. A process of shaping an article made from a hardened age-hardenable, heat treatable aluminum alloy, comprising:

heating the article to a temperature of about 125° C. to about 425° C. at a rate between about 3° C./s to about 200° C./s; and shaping the article, wherein the article is in T6 or T61 temper before the heating step.

2. The process of claim 1, wherein the article is a sheet or a blank.

3. The process of claim 1, wherein the hardened age-hardenable, heat treatable aluminum alloy is a 2XXX, a 6XXX or a 7XXX series alloy.

4. The process of claim 1, wherein the article is heated to a temperature of about 150° C. to about 200° C.

5. The process of claim 1, wherein the article is heated at a rate between about 90° C./s to about 150° C./s.

6. The process of claim 1, wherein the article is heated at a rate between about 3° C./s to about 90° C./s.

7. The process of claim 1, wherein the article is in T6 or T61 temper before and after the heating step.

8. The process of claim 1, further comprising a step of cooling the shaped article.

9. The process of claim 8, wherein the shaping step is a first shaping step and further comprising a second shaping step after the cooling step.

10. The process of claim 9, wherein elongation of the article resulting from the second shaping step is between about 75% to about 125% of the elongation of the heated article resulting from the first shaping step.

11. The process of claim 1, wherein engineering strain of the heated article is about 50 MPa to about 200 MPa.

12. The process of claim 1, wherein elongation of the heated article is increased by up to about 3-20% in comparison to the article prior to heating.

13. The process of claim 1, wherein shaping the article comprises stamping, pressing or press-forming the article.

14. The process of claim 1, wherein the heating the article comprises induction heating.

15. The process of claim 1, wherein the process produces a motor vehicle panel.

16. A shaped article made by a process comprising:

heating the article to a temperature of about 125° C. to about 425° C. at a rate between about 3° C./s to about 200° C./s; and shaping the article, wherein the article is in T6 or T61 temper before the heating step.

17. The shaped article of claim 16, wherein the shaped article is a motor vehicle panel.

18. The shaped article of claim 16, wherein the shaped article has an ultimate tensile strength of at least about 200 MPa.

19. The shaped article of claim 16, wherein the shaped article has an ultimate tensile strength of about 200 MPa to about 275 MPa.

* * * * *